US006674368B2

(12) United States Patent
Hawkins et al.

(10) Patent No.: US 6,674,368 B2
(45) Date of Patent: Jan. 6, 2004

(54) AUTOMATED TRACKING SYSTEM

(75) Inventors: Dale K. Hawkins, Littleton, CO (US); Robert D. Kight, Bailey, CO (US); Terrence J. Sandrin, Denver, CO (US)

(73) Assignee: Continental Divide Robotics, Inc., Littleton, CO (US)

( * ) Notice: Subject to any disclaimer, the term of this patent is extended or adjusted under 35 U.S.C. 154(b) by 0 days.

(21) Appl. No.: 09/940,905

(22) Filed: Aug. 27, 2001

(65) Prior Publication Data

US 2002/0024443 A1 Feb. 28, 2002

Related U.S. Application Data

(60) Provisional application No. 60/228,522, filed on Aug. 28, 2000.

(51) Int. Cl.[7] ..... G08B 23/00

(52) U.S. Cl. ..... 340/573.4; 340/572.1; 340/573.1; 340/572.8; 340/693.5; 340/506; 340/825.39

(58) Field of Search ..... 340/573.4, 572.1, 340/573.1, 5.2, 5.3, 5.33, 505, 10.1, 506, 572.8, 693.5, 539, 825.32, 825.49, 825.54; 379/38

(56) References Cited

U.S. PATENT DOCUMENTS

| | | | | | |
|---|---|---|---|---|---|
| 4,724,427 | A | | 2/1988 | Carroll | 340/572 |
| 4,812,823 | A | | 3/1989 | Dickerson | 340/572 |
| 4,857,893 | A | | 8/1989 | Carroll | 340/572 |
| 4,885,571 | A | | 12/1989 | Pauley et al. | 340/573 |
| 4,918,432 | A | * | 4/1990 | Pauley et al. | 340/573.1 |
| 4,924,211 | A | | 5/1990 | Davies | 340/573 |
| 4,952,913 | A | * | 8/1990 | Pauley et al. | 340/573.1 |
| 4,952,928 | A | * | 8/1990 | Carroll et al. | 340/825.54 |
| 5,043,736 | A | | 8/1991 | Darnell et al. | 342/357 |
| 5,075,670 | A | | 12/1991 | Bower et al. | 340/573 |
| 5,146,207 | A | | 9/1992 | Henry et al. | 340/573 |
| 5,189,395 | A | | 2/1993 | Mitchell | 340/539 |
| 5,204,670 | A | * | 4/1993 | Stinton | 340/825.54 |
| 5,255,306 | A | | 10/1993 | Melton et al. | 379/38 |
| 5,298,884 | A | | 3/1994 | Gilmore et al. | 340/573 |
| 5,448,221 | A | | 9/1995 | Weller | 340/539 |
| 5,461,390 | A | | 10/1995 | Hoshen | 342/419 |
| 5,537,102 | A | | 7/1996 | Pinnow | 340/825.3 |
| 5,568,119 | A | | 10/1996 | Schipper et al. | 340/825.37 |
| 5,583,776 | A | | 12/1996 | Levi et al. | 364/450 |
| 5,661,458 | A | | 8/1997 | Page et al. | 340/573 |
| 5,731,757 | A | | 3/1998 | Layson, Jr. | 340/573 |
| 5,781,155 | A | | 7/1998 | Woo et al. | 342/357 |
| 5,890,068 | A | | 3/1999 | Fattouche et al. | 455/456 |
| 5,892,454 | A | | 4/1999 | Schipper et al. | 340/825.37 |
| 6,014,080 | A | | 1/2000 | Layson, Jr. | 340/573.1 |
| 6,054,928 | A | | 4/2000 | Lemelson et al. | 340/573.4 |
| 6,072,396 | A | * | 6/2000 | Gaukel | 340/573.4 |
| 6,172,640 | B1 | | 1/2001 | Durst et al. | 342/357.07 |
| 6,236,358 | B1 | | 5/2001 | Durst et al. | 342/357.09 |
| 6,421,001 | B1 | | 7/2002 | Durst et al. | 342/357.07 |
| 6,421,608 | B1 | * | 7/2002 | Motoyama et al. | 701/213 |
| 6,441,778 | B1 | | 8/2002 | Durst et al. | 342/357.07 |
| 6,480,147 | B2 | | 11/2002 | Durst et al. | 342/357.07 |

* cited by examiner

*Primary Examiner*—Jeffery Hofsass
*Assistant Examiner*—Daniel Previl
(74) *Attorney, Agent, or Firm*—Sheridan Ross P.C.

(57) ABSTRACT

A method and apparatus for tracking the location of assets and persons are provided. According to the invention, position information is provided to a central monitoring station aperiodically. The central monitoring station utilizes software agents to analyze the information received from remote tags, and to determine the appropriate action to take with respect to that information. In particular, the central monitoring station provides aperiodic notifications to authorized users regarding the position and status of a monitored person or asset. The central monitoring station operates without requiring human analysis of the information received from remote tags. Furthermore, the use of aperiodic transmissions of information to the central monitoring station, and the use of software agents in the central monitoring station, allows the present invention to efficiently process information received from a large number of remote units.

62 Claims, 18 Drawing Sheets

AUTOMATED TRACKING SYSTEM

CROSS-REFERENCE TO RELATED APPLICATIONS

This application claims priority under 35 U.S.C. §119(e) from U.S. Provisional Application Serial No. 60/228,522, filed Aug. 28, 2000, entitled "Automated Tracking System,". The disclosure of U.S. Provisional Application Serial No. 60/228,522 is incorporated herein by reference in its entirety.

FIELD OF THE INVENTION

The present invention relates to tracking the geographic position of assets. In particular, the present invention relates to a method and apparatus for automatically tracking the position of a monitored person, and selectively providing that information to an authorized user.

BACKGROUND OF THE INVENTION

Recent advances in electronic positioning systems have made it possible to determine the geographic location of assets with great precision. Furthermore, advances in wireless communications technology have made it possible to transmit such positioning information from monitored assets to centrally located monitoring stations in real time.

Electronic positioning systems, used in combination with wireless communication technologies are useful in tracking the location of assets, such as goods in transit. Such systems are also useful in connection with monitoring the location of criminal offenders on parole or work release. However, such systems have generally required the use of monitoring personnel at a central control station to ensure that relevant positioning information is provided to authorized consumers of that information. In addition, such systems have been capable of receiving position information only at predetermined times, or in response to a request for positioning information generated by the central monitoring station. Still other systems allow position information to be transmitted to the central monitoring station when a predetermined geographical boundary has been crossed. However, these systems require that a relatively large amount of geographical information be stored in the remote unit. Furthermore, information regarding the position of a tracked asset is seen by human operators at the central control station. Accordingly, the privacy of the information is not maintained.

As an example of previous attempts to provide a locator device for tracking criminal offenders, U.S. Pat. No. 5,461,390 to Hoshen describes a system that includes a remotely located device having a wireless transceiver and a location determination device. In operation, a centrally located system causes a polling signal to be sent periodically to the remote device. In response to the polling signal, the locator device determines its spatial coordinates and transmits a message back to the centrally located station that includes position information. Authorities may be alerted if the remote device is not in an approved location. The system disclosed by Hoshen does not allow the remote device to determine when location information is passed to the centrally located system.

As an example of another attempt that has been made to provide a system for monitoring the location of individuals, U.S. Pat. No. 6,072,396 to Gaukel discloses a system in which positioning information is returned to a central tracking station at predetermined time intervals. The central control tracking station allows operators at the station to review the geographic location of a person being tracked. The system further provides for transmitting position information to consumers of the information at predetermined intervals. The remote unit continuously monitors its location, and immediately transmits a signal indicating that an exclusion zone has been entered or that the remote unit has been tampered with. However, there is no provision of a completely automated central control station, nor is there disclosure of a remote unit capable of storing and/or transmitting position information aperiodically according to factors other than or in addition to the position of the unit at a particular moment in time and tampering with the unit.

As an example of still another attempt to incorporate the tracking device and the proximity detector into a common ankle mounted device, U.S. Pat. No. 6,014,080 to Layson describes a system requiring a matched filtering GPS receiver and a field programmable gate array. The system disclosed by Layson requires a specialized GPS receiver and special hardware. The system proposed by Layson also requires a wireless link to provide "almanac data every hour."

For the above-stated reasons, it would be advantageous to provide an improved method and apparatus for providing position information concerning a tracked person or object. In particular, it would be advantageous to provide a method and apparatus that allows for positioning information to be transmitted to authorized users, without the need for monitoring of that information by personnel located at a central monitoring station. Furthermore, it would be advantageous to provide a method and apparatus that allowed for the transmission of position or other information when such information is particularly relevant, rather than at predetermined intervals. It would additionally be advantageous to provide such information after weighing a variety of factors having to do with the relevance of such information. It would also be advantageous to provide a method and apparatus for passive tracking that can achieve the required low power operation at a reduced cost by using a standard aided GPS receiver, standard hardware design techniques, and that did not require a wireless link. Furthermore, it would be advantageous to provide such a method and apparatus that can be implemented at an acceptable cost, that allows for the efficient tracking of a large of number of persons or objects, and that it is reliable in operation.

SUMMARY OF THE INVENTION

In accordance with the present invention, a system for tracking the location of persons or assets is provided. The disclosed system generally includes a remote tag, a central monitoring station, and a user interface. In general, the remote tag provides positioning information to the central monitoring station aperiodically. The information received from the remote tag is processed by the central monitoring station, without requiring human intervention. The information received from the remote tag may be provided to an authorized user in near real time, or may be stored for later review by the authorized user.

According to an embodiment of the present invention, the times at which positioning information is transmitted from the remote tag to the central monitoring station are determined upon consideration of a variety of factors. These factors are designed to allow the remote tag to consider the relevance of the position information on hand. For example, if a large amount of information is stored in the remote tag, a relatively large distance has been traveled since information was last transmitted, a relatively large period of time has elapsed since the last transmission, the battery status is low, whether a particular communication channel is available, movement of the remote tag toward a restriction or exclusion zone boundary, and a high status level assigned to the person or object being tracked, may all favor transmission of information. If such factors, alone or in combination, do not favor immediate transmission, the transmission of information may be deferred.

According to one embodiment of the present invention, an authorized user may be provided with position information concerning a tracked person or object in near real time. Notification of the authorized user may be accomplished using a variety of methods. For instance, where the positioning information to be transmitted is of low priority, that information may be provided using a communication method that is relatively unobtrusive to the authorized user. For instance, such information may be transmitted as part of an e-mail message. Higher priority information may be communicated by telephone or facsimile. Information may also be provided by paging the authorized user. In addition, where, for example, the positioning information is determined to be of very high priority, it may be transmitted to both an authorized user and another person associated with the authorized user, such as a supervisor. The levels, methods of contact, and identities of contact personnel can all be selected by the authorized user.

According to one embodiment of the present invention, the remote tag is used in connection with a companion device having a proximity verification feature, such as an ankle tag. In general, the ankle tag or other companion device is semi-permanently affixed to a person being tracked. The companion device periodically emits an identification signal that is received by the remote tag. If the companion device is more than a certain distance from the remote tag, a signal indicating that the person being tracked may not be at the same location as the remote tag is generated by the remote tag. This information may be selectively provided to an authorized user.

According to still another embodiment of the present invention, the system includes a base station for use in, for example, a monitored person's home. The base station may include a connector to allow the remote tag to use a communications device installed as part of the base station to transmit information to the central monitoring station. The base station may also include a receiver for detecting the proximity of an ankle tag or other companion device. According to one embodiment, the proximity detector provided as part of the base station has a greater range than the proximity detector of the remote tag to allow the monitored person to move about within an area surrounding the base station of about 150 feet.

According to yet another embodiment of the present invention, whether information is to be forwarded to an authorized user in near real time is determined according to the operation of software agents operating as part of the central monitoring station. According to this embodiment of the present invention, software agents are provided to perform discrete tasks with respect to information received from remote tags. For instance, a first such agent determines whether the location of a remote tag violates an exclusion or inclusion zone established with respect to that tag. If the remote tag is not in an authorized location an alert can be generated. A second software agent may be provided for comparing the location of a first remote tag to any other monitored remote tag. An alert may be generated if, for example, two or more remote tags associated with parolees are determined to be in the same location. Yet another agent may store position and other information received from remote tags in records associated with the appropriate tag or authorized user for archival purposes or later review. Still another software agent may consider alerts generated by any other agent and determine whether to notify an authorized user of an alert. In addition, the appropriate method by which the authorized user is notified of the alert condition can be determined. In this way, a large amount of incoming information can be efficiently processed.

According to still another embodiment of the present invention, the system provides for passive tracking. According to such an embodiment a remote tag having a GPS receiver is used to determine the position of the tracked person or object, and the movements of the tracked person or object are stored in memory for download "en masse" at the end of each day (or even once a week). Passive tracking removes the need for any long-range wireless communication, eliminating the associated cost, power consumption, noise/interference, and service coverage issues. The passive tracker tag can be smaller, lighter, and cheaper. Consequently, the daily operating costs are significantly reduced. In addition, a continuous historical account of the whereabouts of a tracked person or object is maintained, allowing authorized users to ensure that exclusion or inclusion zones have been complied with.

Based on the foregoing summary, a number of salient features of the present invention are readily discerned. A system for remotely monitoring the position of persons or objects is provided. The system allows information regarding the position of the person or object to be transmitted to the central monitoring station when such information is particularly relevant. Accordingly, the system of the present invention transmits information from the remotely located tag to the central monitoring station aperiodically. In addition, information is provided to authorized users without requiring intervention by monitoring personnel. Positioning information may be accessed when desired by authorized users. In addition, notification of relevant positioning information is provided to authorized users aperiodically, when such information is deemed to be particularly relevant.

Additional advantages of the present invention will become readily apparent from the following discussion, particularly when taken together with the accompanying drawings.

DETAILED DESCRIPTION

Figure 1:
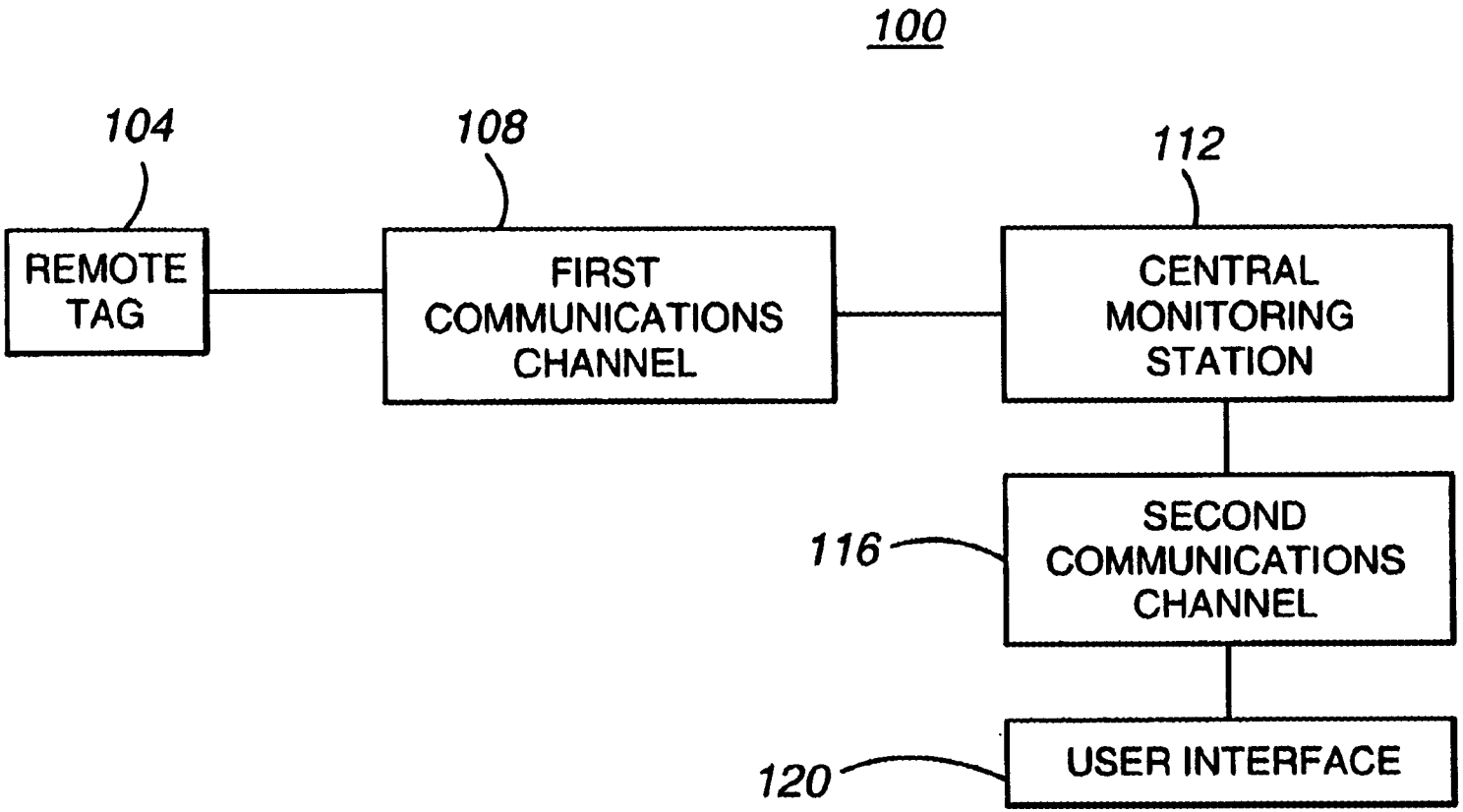
FIG. 1 is a block diagram representing a system in accordance with the present invention.

FIG. 1 illustrates the major components of a system 100 adapted for the automated tracking of persons or objects. The system 100 generally includes a remote tag 104, a first communications channel 108, a central monitoring station 112, a second communications channel 116 and a user interface 120. The user interface 120 may comprise an e-mail account, a telephone or facsimile number, a pager, a graphical user interface, a computer program allowing a pop-up notification, or any other means of providing information to a user. In general, communications between the remote tag 104 and the central monitoring station 112 are aperiodically conducted over the first communications channel 108. Information transmitted over the first communications channel 108 generally includes information concerning the position of the remote tag 104 and the status of the remote tag 104 hardware. Communications between the central monitoring station 112 and the user interface 120 are aperiodically established over the second communications channel 116.

Figure 2A:
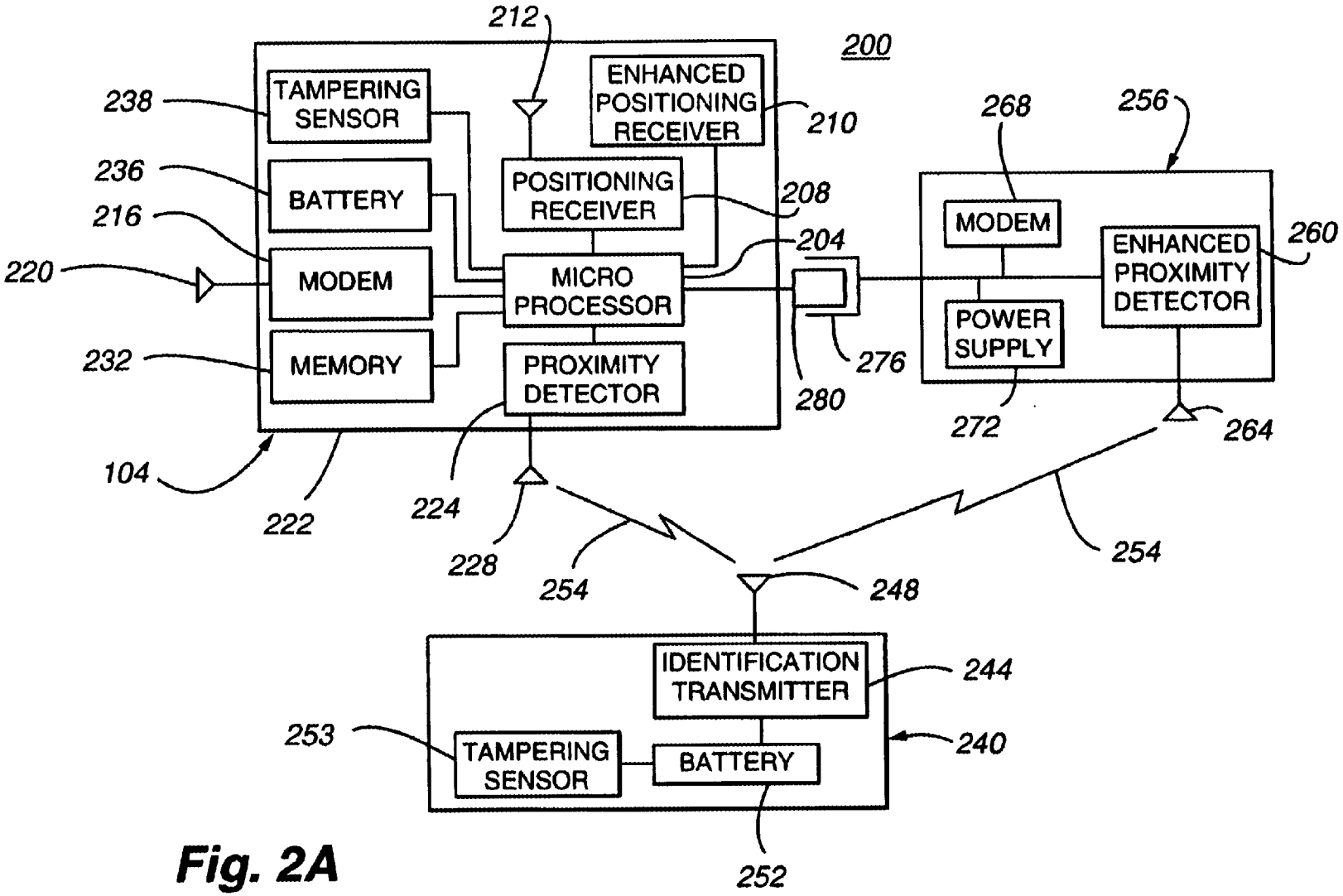
FIG. 2A is a block diagram representing a remote subsystem in accordance with an embodiment of the present invention.

With reference now to FIG. 2A, a remote tag 104 and associated components that together comprise a remote subsystem 200 in accordance with an embodiment of the present invention are illustrated. As seen in FIG. 2A, the remote tag 104 generally includes a microprocessor 204, a positioning receiver 208 and associated antenna 212, and a modem 216 and associated antenna 220, all positioned within a casing 222. In addition, the remote tag 104 may include a proximity detector 224 and associated antenna 228, memory 232, and battery 236. In general, the processor 204 may conveniently comprise any programmable microprocessor or digital signal processor. The positioning receiver 208 may include any device capable of receiving positioning information and providing position information to the microprocessor 204. For instance, the positioning receiver 208 may comprise a global positioning system (GPS) receiver. In addition or alternatively, the positioning receiver 208 may include a differential global positioning system receiver, a LORAN receiver, or other electronic positioning receiver. The remote tag 104 may also be provided with a second, enhanced positioning receiver (or aided GPS receiver) 210, such as the location determination system available from SNAP TRACK INC., SIRF, Global Locate, or others. The modem 216 may be any communications device capable of transmitting information from the remote tag 104 to the central monitoring station 112. Preferably, the modem 216 allows at least one wireless communications channel 108 to be utilized by the remote tag 104 in transmitting information. Accordingly, the modem 216 may comprise a cellular digital packet data (CDPD) modem, an analog cellular modem, a digital cellular modem, a satellite transceiver, a wireline modem, a Data TAC modem, a Reflex-25 two way pager modem, or other wireless packet data modem, a Bluetooth, Ricochet, or IrDA communications device, or other device capable of transmitting information. A tampering sensor 238 may also be provided. The tampering sensor 238 may comprise a continuity detector around the exterior of the casing 222 to indicate whether the casing 222 has been opened. The tampering sensor 238 may also comprise a mechanical switch and/or a light sensitive switch to detect whether the casing 222 has been opened.

According to one embodiment of the remote tag 104, the microprocessor 204 is a TMS 320C548 digital signal processor available from Texas Instruments. The positioning receiver 208 is a global positioning system receiver using a Surfstar 1 chip set and a Hitachi H1 microcontroller. The modem 216 is a CDPD modem model NRM6812 available from Novatel Wireless. The memory 232 comprises 8 megabytes of flash memory and 256 kilobytes SRAM. The battery 236 is an 11 Ampere, 7.2 Volt lithium-ion battery. The proximity detector 224 is available from BI Incorporated, and works in conjunction with a proximity verification device 240.

The proximity verification device 240 may include an identification transmitter 244 and associated antenna 248, and a battery 252. The proximity verification device 240 may also include a tampering sensor 253, such as a continuity detector, to sense whether the device 240 has been removed or opened. In general, the proximity verification device 240 is semipermanently affixed to criminal offenders. An identification signal 254 transmitted from the identification transmitter 244 is received by the antenna 228 of the proximity detector 224 associated with the remote tag 104. However, if the monitored offender takes off the remote tag 104 and moves away from the remote tag 104, the identification signal 254 produced by the identification transmitter 244 will not be detected by the proximity detector 224. Therefore, the system can determine whether an offender is attempting to thwart the monitoring of his or her position by traveling without the remote tag 104. According to one embodiment of the present invention, the signal 254 generated by the identification transmitter 244 will not be detected by the proximity detector 224 if the proximity verification device 240 is more than about 25 feet from the remote tag 104. Of course, where the system 100 is not being used in connection with a criminal offender, the proximity verification device 240 and the proximity detector 224 need not be provided.

A base station 256 is also illustrated in FIG. 2A. The base station 256 generally includes an enhanced proximity detector 260 and associated antenna 264, a modem 268, and a power supply 272. The base station 256 may also be provided with a connector 276 that can be used to interconnect the base station 256 to the remote tag 104 via a mating connector 280 provided on the remote tag 104. The base station 256 may, for example, be placed in the home of a person being monitored. The enhanced proximity detector 260 allows the detection of the identification signal 254 transmitted by the identification transmitter 244 to be detected so long as the proximity verification device 240 is within a predetermined distance from the base station 256. According to one embodiment of the present invention, the enhanced proximity detector 260 will detect the identification signal 254 so long as the proximity verification device is within about 150 feet of the base station 256. Accordingly, a system 100 provided with a base station 256 allows an offender to move about his or her home without requiring the offender to carry the remote tag 104. According to another embodiment of the present invention, the enhanced proximity detector 260 is incorporated into the remote tag 104.

In addition, the base station 256 may also provide a power supply 272 for recharging the battery 236 of the remote tag 104. The battery 236, according to another embodiment of the present invention, may also be recharged using direct connections between a power source, such as a household or automobile electrical system and the remote tag 104. The base station 256 may also provide an alternative communication means via a modem 268. For instance, when the remote tag 104 and the base station 256 are interconnected using the connectors 276 and 280, information stored in the memory 232 of the remote tag 104 may be transmitted to the central monitoring station 112 using the modem 268. As an alternative or in addition to the connectors 276 and 280, information may be passed between the remote tag 104 and the base station 256 using a wireless communication link. The modem 268 may be a wireline modem interconnected to the telephone line of the person being monitored. Alternatively, the modem 268 may be any other means capable of communicating information to the central monitoring station 112, such as a wireless modem. As with the proximity verification device 240, the base station 256 need not be provided when the system 100 is not being used in connection with a criminal offender or is not being used in connection with the monitoring of a person that requires constant verification of that person's geographic location.

Figure 2B:
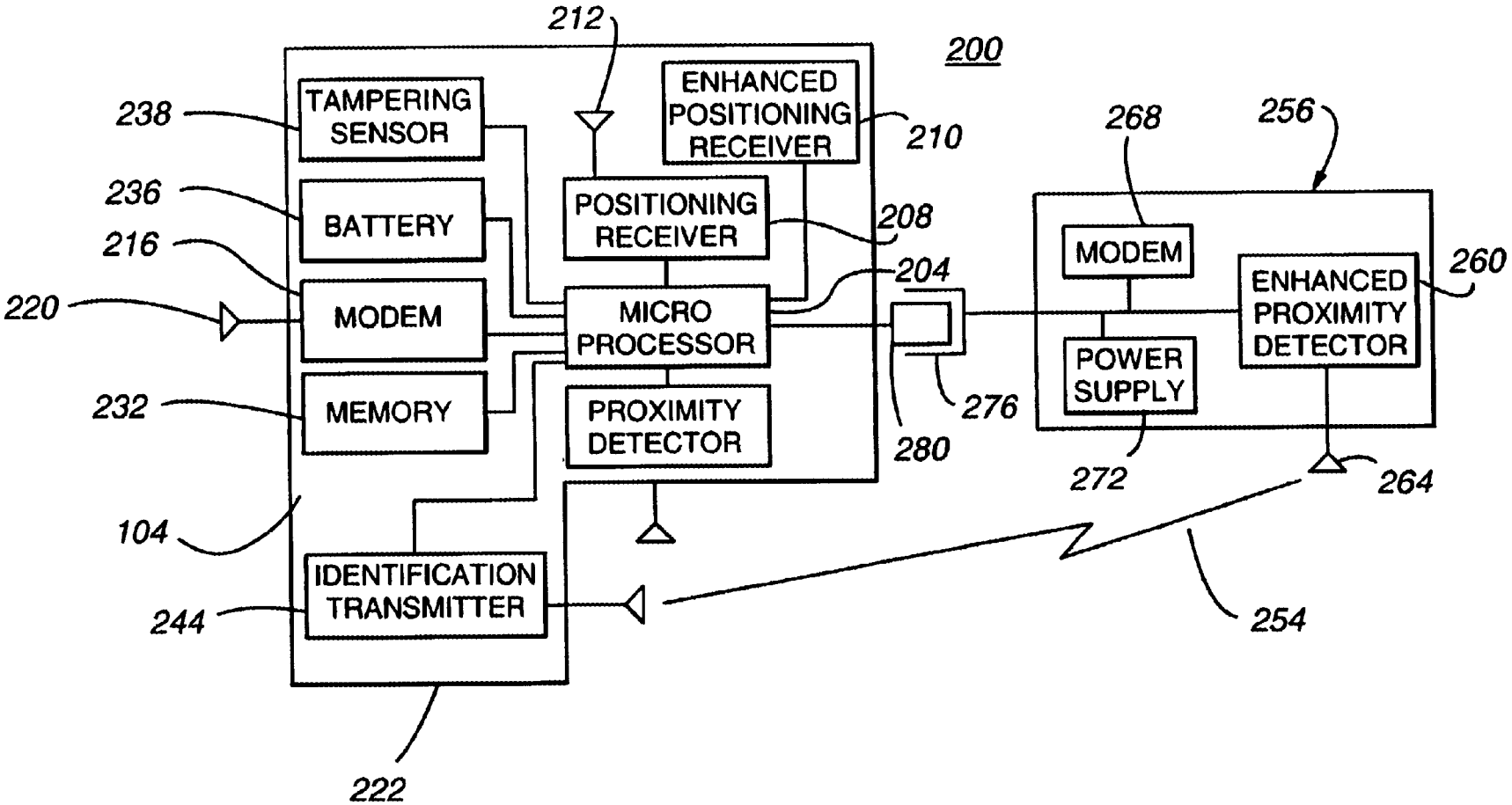
FIG. 2B is a block diagram representing a remote subsystem in accordance with another embodiment of the present invention.

With reference now to FIG. 2B, an embodiment of the present invention having a remote tag 104 that incorporates the components of the proximity verification device 240 (FIG. 2A) is shown. Thus, according to such an embodiment, the remote tag 104 includes an identification transmitter 244 that generates a signal 254 that is detected by the enhanced proximity detector 260 if the remote tag is within a predetermined distance from the base station 256. The embodiment having a remote tag 104 with an identification transmitter 244 therefore can house the components of the remote subsystem 200 that will generally travel with the person or object being tracked in a single casing 222. Also, the embodiment illustrated in FIG. 2B can operate with a single battery 236 (i.e. battery 252 of the embodiment of FIG. 2A is eliminated) and a single tampering sensor 238 (i.e. tampering sensor 252 of the embodiment of FIG. 2A is eliminated).

According to still another embodiment of the present invention, such as in connection with a remote subsystem 200 that is not intended for use with criminal offenders, an identification transmitter 244 need not be provided. Also, tampering sensors 238 and 253 are not required, particularly where intentional tampering with components of the remote subsystem 200 is unlikely.

Figure 2C:
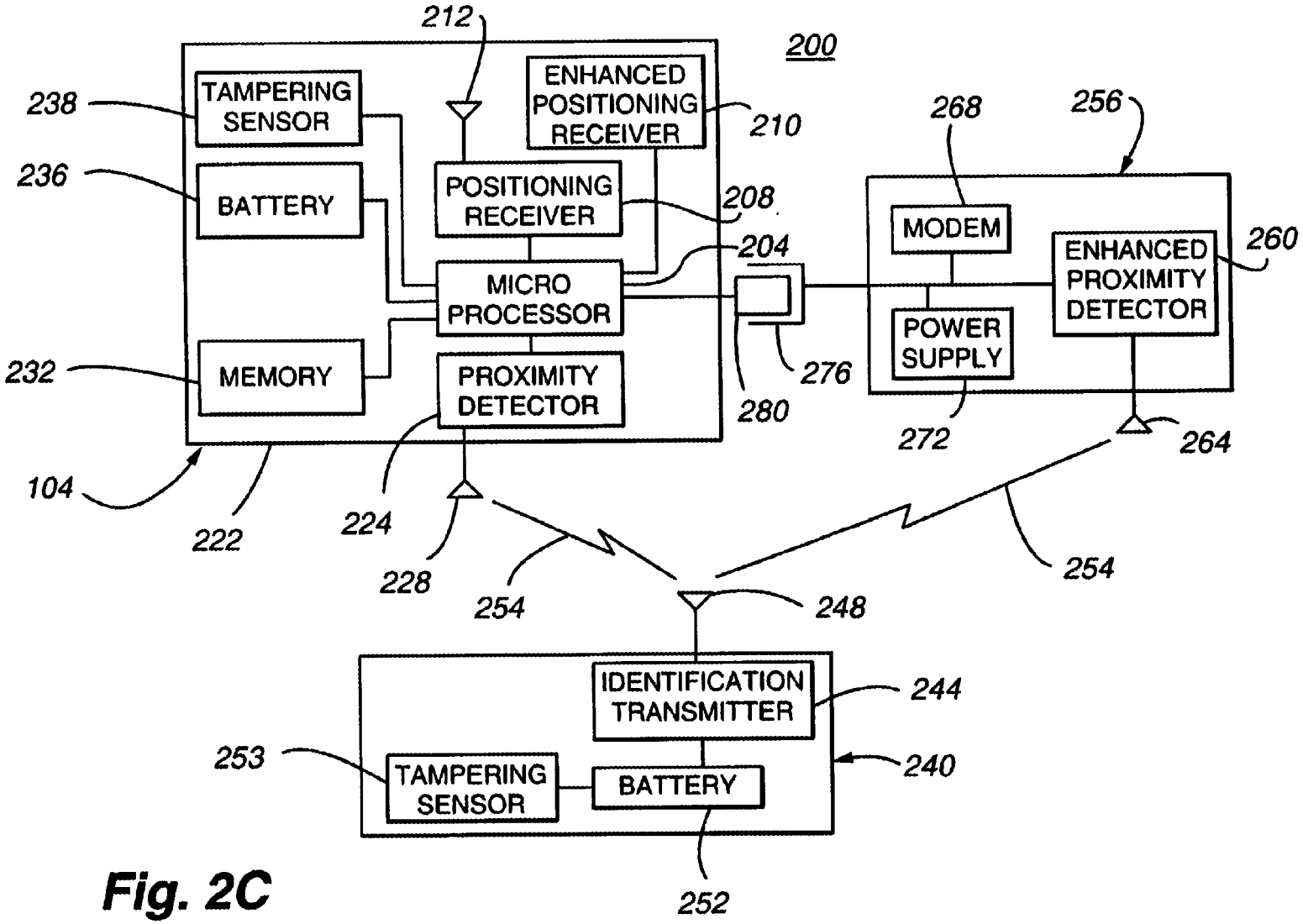
FIG. 2C is a block diagram representing a remote subsystem in accordance with still another embodiment of the present invention.

With reference now to FIG. 2C, a remote subsystem 200 that provides passive tracking is illustrated. According to such an embodiment of the present invention, the remote tag 104 does not include a modem 216 (see FIGS. 2A and 2B). Therefore, data collected by the remote tag 104 is provided to the base station 256 when the remote tag 104 is in communication with the base station, either through connectors 276 and 280 or a wireless link, and transmitted to the central monitoring station 112 by the base station modem 268. The remote subsystem 200 providing passive tracking accordingly removes the need for a modem 216 capable of providing long range wireless communications. Data from the remote tag 104 may be transmitted to the central monitoring station 112 whenever the remote tag 104 is placed in communication with the base station 256, when a certain quantity of data has been collected, and/or when a particular event or events has occurred.

Figure 2D:
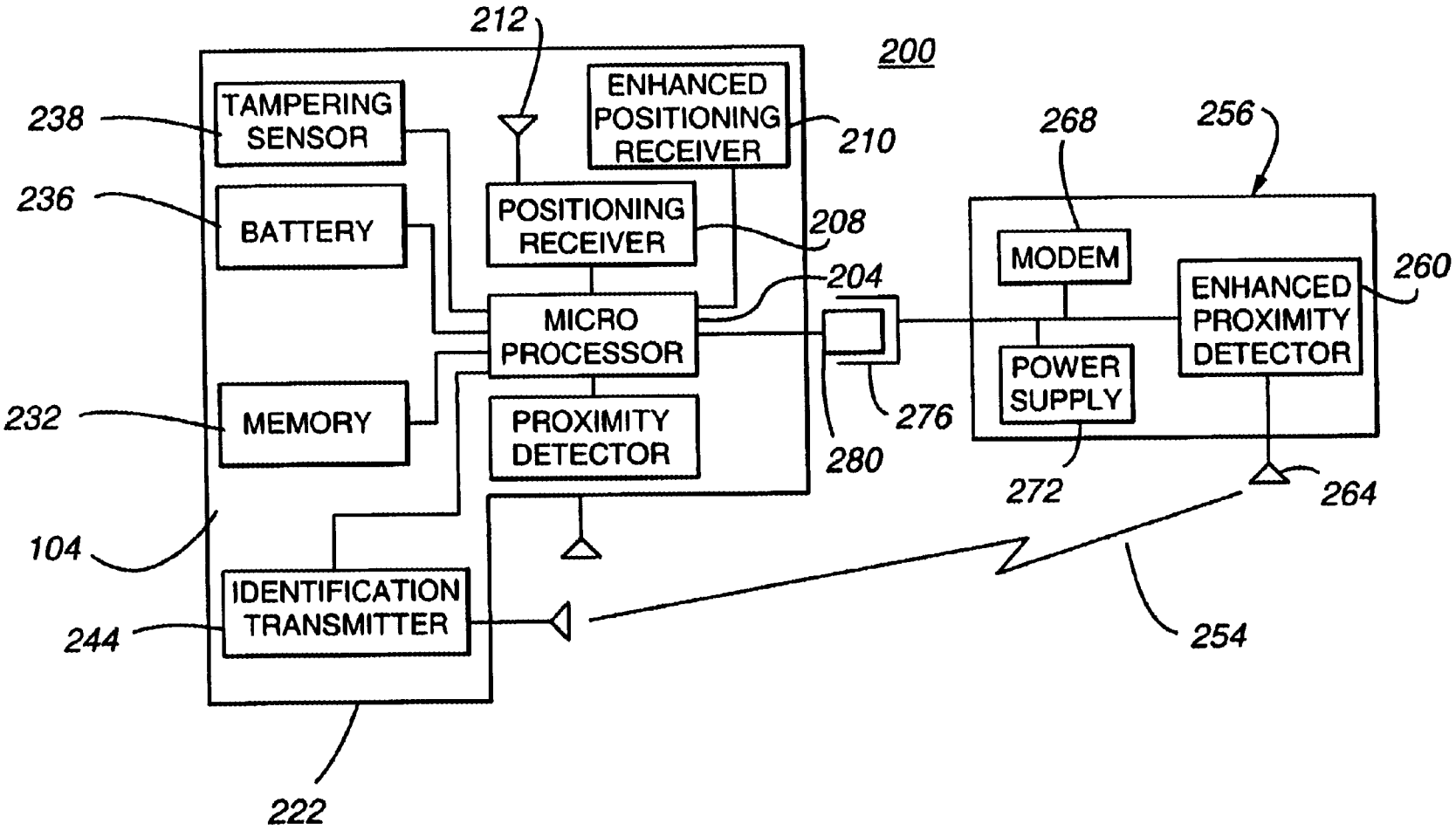
FIG. 2D is a block diagram representing a remote subsystem in accordance with yet another embodiment of the present invention.

With reference now to FIG. 2D, a remote subsystem 200 that provides passive tracking and that features a remote tag 104 that incorporates the components of the proximity verification device 240 (FIG. 2A) is illustrated. Accordingly, the embodiment illustrated in FIG. 2D includes an identification transmitter 244 that generates a signal 254 that is detected by the enhanced proximity detector 260 in the base station 256 if the remote tag is within a predetermined distance from the base station 256. Furthermore, the components of the remote subsystem 200 that will generally travel with the person or object being tracked are contained in a single casing 222. As with the embodiment illustrated in FIG. 2B, the casing 222 enclosing the components of the remote tag 104 can be worn on the ankle of the person being tracked. The embodiment illustrated in FIG. 2D also allows the remote tag 104 to operate with a single battery 236 and a single tampering sensor 238.

Because the remote tag 104 illustrated in FIG. 2D does not include a modem, data collected by the remote tag 104 is provided to the base station 256 when the remote tag 104 is in communication with the base station 256. Communication between the remote tag 104 and the base station 256 may be established over a wireless link, or through connectors 276 and 280. The data may then be transmitted to the central monitoring station 112 by the base station modem 268. As with the other embodiments of the present invention, the modem 268 may be a wire line modem, or a wireless modem. The transmission of data from the base station 256 to the central monitoring station 112 may occur whenever the remote tag 104 is placed in communication with the base station 256, when a certain quantity of data has been collected by the remote tag 104, and/or when data concerning a particular event or events has been collected by the remote tag 104.

Figure 3:
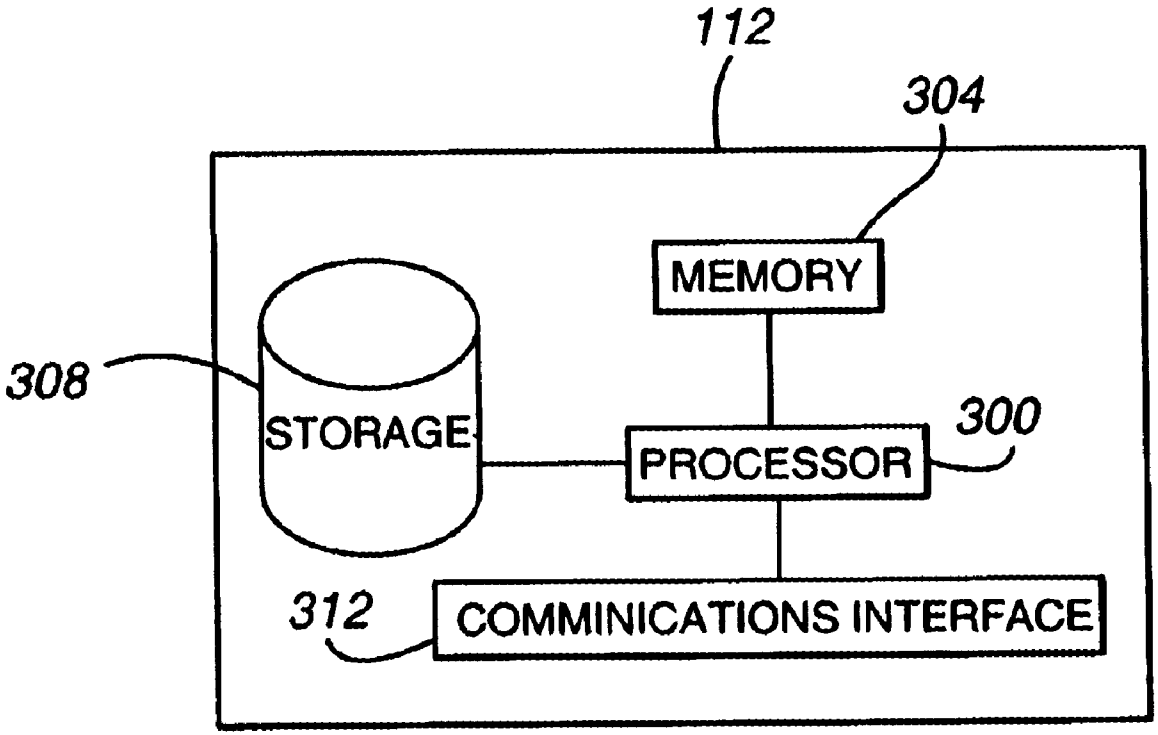
FIG. 3 is a block diagram representing a central monitoring station in accordance with an embodiment of the present invention.

With reference now to FIG. 3, a central monitoring station 112 in accordance with an embodiment of the present invention is illustrated. The central monitoring station 112 generally includes at least one processor 300, memory 304, data storage 308 and a communications interface 312. In general, the processor 300 may be any computer processor suitable for executing software. For example, the processor 300 may comprise one or more PENTIUM class processors. The memory 304 may be solid state RAM suitable for use in connection with the processor 300. According to one embodiment of the present invention, 128 megabytes of RAM are used. The storage 308 may include any form of storage suitable for storing relatively large quantities of data. For instance, the data storage 308 may comprise one or more hard disk drives, tape drives, optical storage devices or any other suitable storage device or combination thereof. The communications interface 312 provides connectivity to the remote tag 104 and the user interface 120 over the first communications channel 108 and second communications channel 116 respectively. In addition, if the system 100 is supplied with a base station 256, the communications interface 312 may interconnect the central monitoring station 112 to the base station 256. Accordingly, it should be understood that the communications interface 312 may comprise one or a plurality of individual communications devices. For instance, where the first communications channel 108 and the second communications channel 116 comprise a computer network, the communications interface 312 may comprise a single network connection. Alternatively, the central monitoring station 112 may comprise any number and type of communications interfaces to enable the central monitoring station 112 to communicate with the remote tag 104, user interface 120 and, if supplied, the base station 256.

Figure 4:
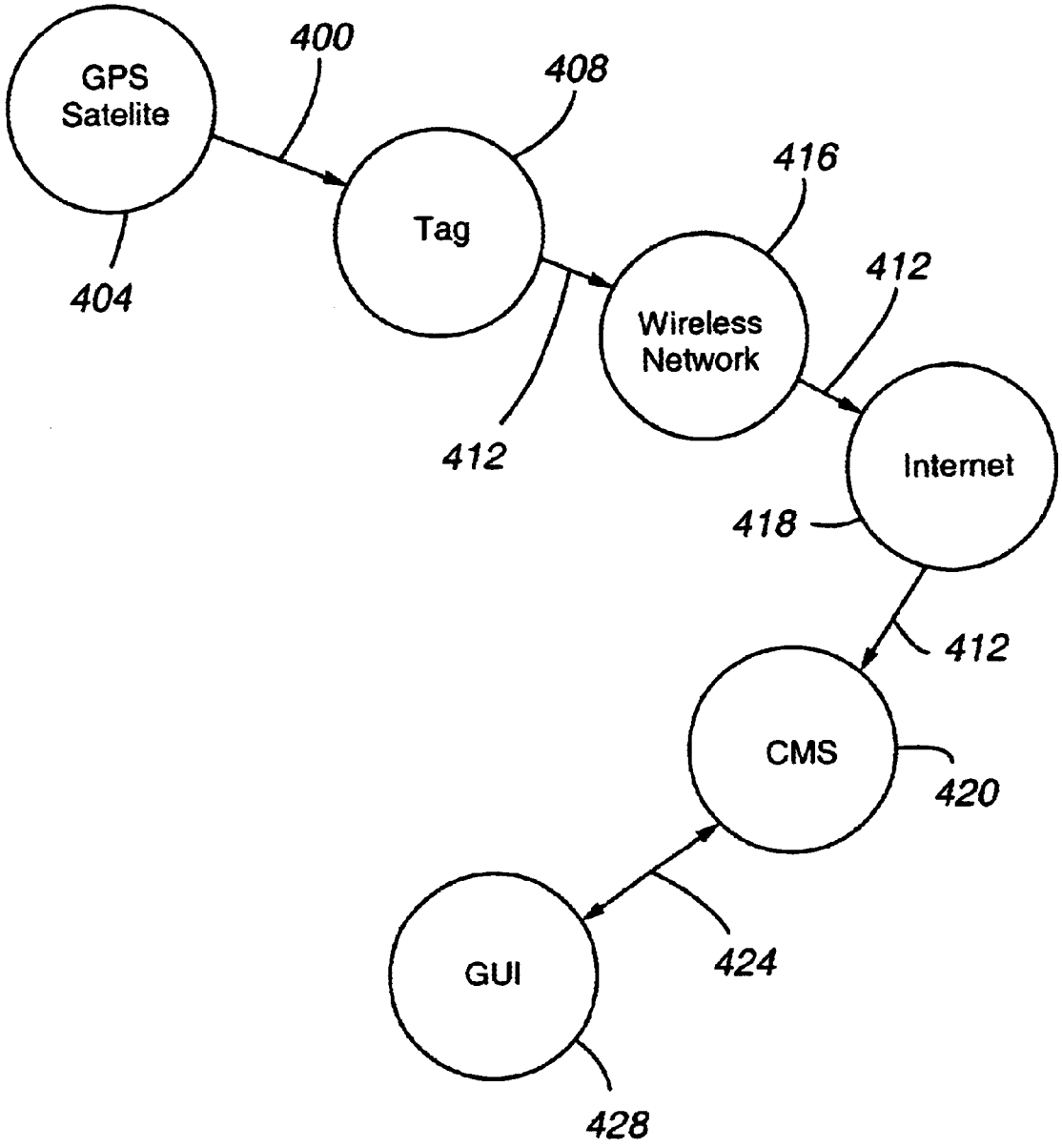
FIG. 4 is a flowchart representing the flow of information through a system in accordance with an embodiment of the present invention.

FIG. 4 represents the flow of information through a system 100 in accordance with an embodiment of the present invention. Initially, positioning signals 400 are received from global positioning system (GPS) satellites 404. The positioning receiver 208 in the remote tag 104, in this example a GPS receiver, receives the positioning signals 400 at step 408. The positioning receiver 208 decodes the positioning signals 400 and provides the resulting information 412 regarding the geographic location of the tag 104 to the microprocessor 204. The remote tag 104 then transmits the position information 412, together with an associated time, over a communications channel 108 to a wireless network 416. In general, when a remote tag 104 having a modem 216 is not connected to a base station 256, the modem 216 is used to transmit the position information 412 to the wireless network 416. When the remote tag 104 is connected to a base station 256, the modem 268 provided as part of the base station 256 may be used, and the information may be transmitted to a communications server over a land-line network rather than the wireless network 416. From the wireless network 416, the position information 412 is transmitted to the central monitoring station 112 (step 420) via, for example, the Internet 418. Of course, it will be understood that any communications or computer network may comprise the portion of the communications channel 108 that conveys the position information 412 to the central monitoring station 112.

The position information 412 is processed in the central monitoring station 112 (step 420) and selected information 424 is provided to the user interface at step 428. Generally, as will be described in greater detail below, the selected information 424 includes only information pertaining to a remote tag associated with a person or thing being tracked by an authorized user at a particular user interface 120. In addition, only highly relevant or more relevant information may be directed to the user interface 120 by the central monitoring station 112. However, the selected information 424 may consist of all of the information to which an authorized user is entitled. For instance in response to a request for all such information received from the authorized user, all information relevant to a person or asset associated with the authorized user may be provided to the user interface 120. According to one embodiment of the present invention, the user interface 120 is a graphical user interface operating on a computer at the workplace of an authorized user. According to another embodiment of the present invention, the user interface 120 may comprise an Internet browser, a telephone, a facsimile machine, a pager or an application running on a device other than a personal computer, such as a personal digital assistant (PDA). The user interface 120 may also comprise a combination of such interfaces. In general, the user interface 120 may comprise any means of providing information to an authorized user. In a preferred embodiment, at least one user interface 120 available to a particular user allows that user to request information, in addition to providing information at times determined by the central monitoring station 112.

Figure 5:
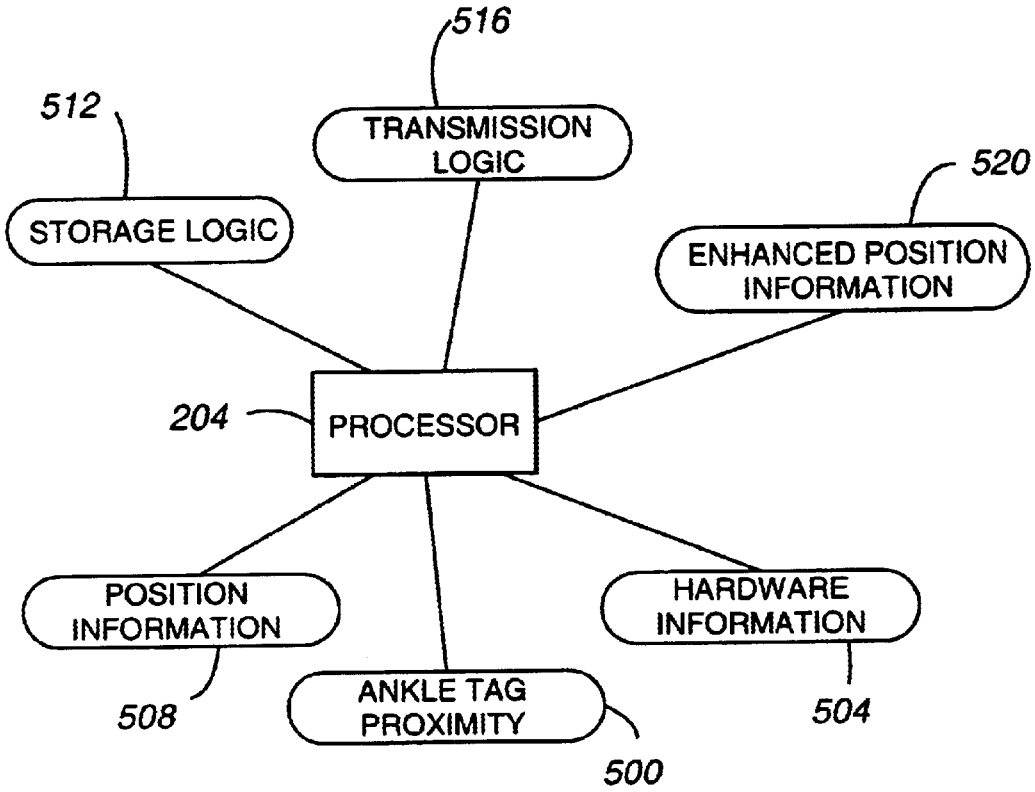
FIG. 5 depicts various subroutines that may be run on a remote tag in accordance with an embodiment of the present invention.

With reference now to FIG. 5, aspects of the operation of a remote tag 104 in accordance with an embodiment of the present invention are illustrated. In particular, FIG. 5 illustrates subroutines that may be run on the microprocessor 204 of the remote tag 104 during operation of the remote tag 104. The subroutines illustrated in FIG. 5 need not be run in any particular order or even sequentially. In general, the subroutines run continuously in parallel with one another in a multithreaded environment. Accordingly, even though the microprocessor 204 may handle discrete processing tasks from the subroutines sequentially, the subroutines overall run simultaneously.

The ankle tag proximity subroutine 500 ensures that a valid identification signal 254 is received by the proximity detector 224 of the remote tag 104. In general, a valid identification signal 254 is one that contains the identification number of the ankle tag or other companion device 240 that has been assigned to the person carrying the remote tag 104. Where the remote tag 104 is interconnected to a base station 256, the ankle tag proximity subroutine 500 ensures that the enhanced proximity detector 260 receives a valid identification signal 254. The ankle tag proximity subroutine 500 may generate a signal indicating that the companion device 240 has not been detected if a valid identification signal 254 is not received.

The hardware information subroutine 504 checks that various hardware parameters associated with the remote tag 104 and, if supplied, the proximity verification device 240, are within acceptable ranges or in acceptable condition. For instance, the hardware information subroutine 504 may check the status of the battery 236. The hardware information subroutine 504 may also check the status of tampering sensors 238 and 253.

The position information subroutine 508 processes position information received from the positioning receiver 208. The position information subroutine 508 may also associate a time with discrete pieces of position information. Furthermore, the position information subroutine 508 may assess the validity of position information received from the positioning receiver 208. For instance, the position information subroutine 508 may determine that position information is invalid if the positioning receiver 208 indicates that the position information is old or is unreliable. The information may also be found to be invalid if information from the wireless network 416 regarding the position of the remote tag 104 does not agree with the positioning information from the positioning receiver 208. Where positioning information is determined to be invalid, a signal so indicating may be produced.

The storage logic subroutine 512 determines whether a particular set of position or hardware information will be stored in the memory 232 of the remote tag 104, while the transmission logic subroutine 516 determines whether such information will be transmitted to the central monitoring station 112. The operation of the storage logic subroutine 512 and transmission logic subroutines 516 will be discussed in greater detail below. The subroutines that run on the microprocessor 204 may also include an enhanced position information subroutine 520 for determining whether positioning information in addition to the standard position information will be sought by the remote tag 104, as will also be discussed in greater detail below.

Figure 6:
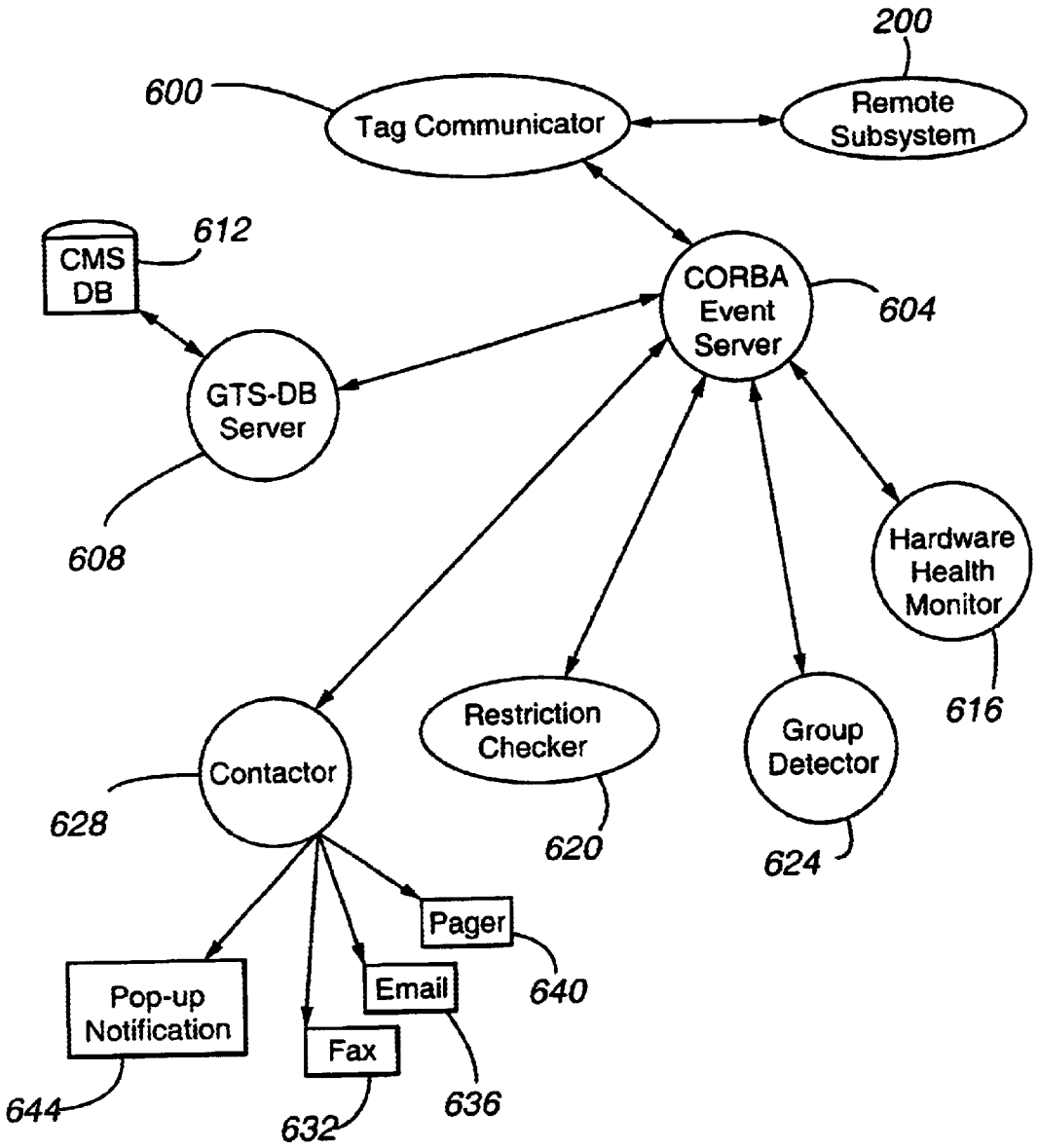
FIG. 6 is a flowchart illustrating the relationships between various components of a system in accordance with an embodiment of the present invention.

With reference now to FIG. 6 the relationship between various components of a system 100 in accordance with an embodiment of a present invention is illustrated. In particular, FIG. 6 depicts the major software functions of the central monitoring station 112.

The software modules of the central monitoring station 112 include a tag communicator 600, an event server 604, software agents 608 and 616 to 628 and a database 612. Generally, the tag communicator 600 receives information from the remote subsystem 200 and converts that information into one or more software events. The software events are then provided to the event server 604. The event server 604 may then provide each event to each of the software agents 608 and 616 to 628. According to another embodiment of the present invention, the event server 604 provides some or all events to the software agents 608 and 616 to 628. For instance, an alert event generated by the group detector 624 subroutine could be provided only to the server 608 and contactor 628 subroutines.

The database server agent 608 generally functions to store events in appropriate records in the database 612. For instance, the database server 608 may store position information received concerning a particular person or asset being tracked in one or more records associated with that person. According to one embodiment of the present invention, every event generated with respect to a person or asset being tracked is stored in the database 612. According to another embodiment of the present invention, only selected position information events and all alert events are stored in the database 612. The information stored in the database 612 may be purged after selected periods of time.

The hardware health monitor agent 616 considers events containing information regarding the remote subsystem 200 hardware. If any hardware parameter is determined by the hardware health monitor 616 to be in an unacceptable condition, an alert event may be generated. For instance, an alert may be generated if the battery 236 is low on charge or if the tampering sensors 238 or 253 indicate an attempt to tamper with the remote unit 104 or proximity verification device 240.

The restriction checker agent 620 compares position information received regarding a particular person or object being tracked to restriction or exclusion zones established for the particular person or object. If it is determined that the person or object being tracked has left an area in which they are required to stay, or has entered an area that they are to stay out of, an alert event may be generated. The boundaries of restriction zones and exclusion zones and the times during which such zones are in effect may be determined by the authorized user, and may be entered using the user interface 120.

The group detector 624 considers position information and determines whether a prohibited group has formed. For instance, the group detector 624 determines whether two or more parolees are in close proximity to one another, a situation that may signal that parolees are engaging in prohibited interactions. In considering whether a prohibited group has formed, the group detector 624 may consider the location of the persons being tracked. For example, if the persons being tracked are parolees and the detected group is in or near a parole office or an employer whose workforce includes one or more parolees, the group detector may decline to issue an alert event. The categories of assets or persons comprising a prohibited group, and the geographic and temporal boundaries of the group detection function may be determined by the authorized user, and may be entered using the user interface 120.

The contactor agent 628 generally acts upon alert events issued by other agents, determines the authorized user to whom the alert is to be provided, and determines the method by which the alert is to be delivered. For example, a low level alert may be provided by e-mail 636 and a pop-up notification 644 in a user interface 120. A higher level alert may be communicated to an authorized user by an e-mail notification 636, a pop-up notification 644, and a facsimile message 632. A still more serious alert may be provided by the aforementioned methods, and in addition the authorized user may be paged 640. Generally, the contact addresses and types of notifications for given alert events may be determined by the authorized user. In addition, notification of alert events may be provided to more than one authorized user. For instance, a high level alert event may be communicated by paging both an authorized user (e.g. a parole officer) or another person associated with the authorized user (e.g. the authorized user's supervisor). The type of notification and the persons notified may be determined by the authorized user and may be entered using the user interface 120.

Figure 7:
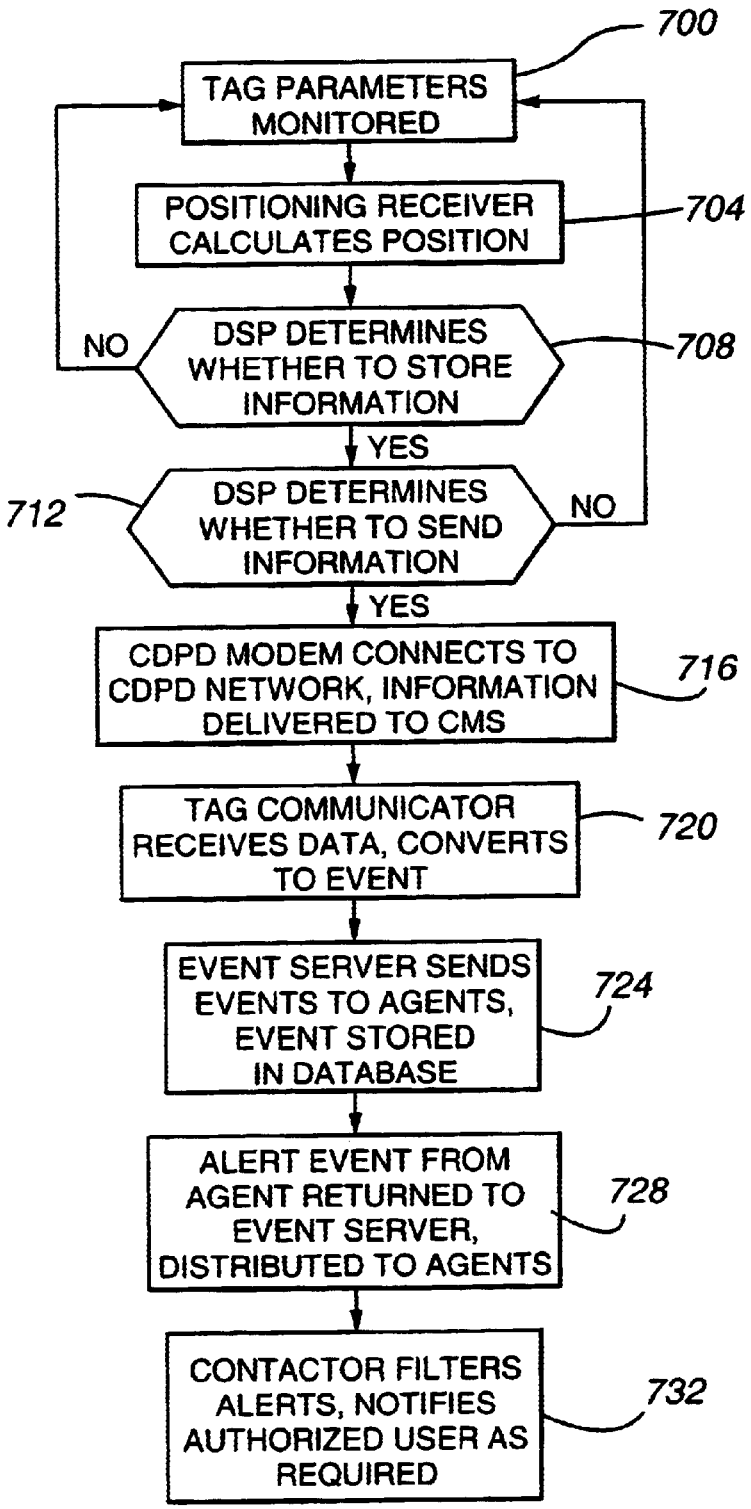
FIG. 7 is a flowchart illustrating the logical operation of a remote tag in accordance with an embodiment of the present invention.

With reference now to FIG. 7, the operation of a system 100 in accordance with an embodiment of the present invention is illustrated. Initially, at step 700, hardware parameters of the remote tag 104 are monitored in the remote tag 104. If hardware problems are detected, a signal may be sent to the central monitoring station 112 for action. At step 704 the positioning receiver 208 calculates the present position of the remote tag 104. At step 708 the microprocessor 204 invokes the storage logic subroutine 512 to determine whether to store the position and hardware information in the memory 232 of the remote tag 104. In general, if information is not to be stored in memory 232, the system continues to monitor the hardware parameters and the position of the remote tag 104. If a decision is made to store the information, the transmission logic subroutine 516 determines whether to send the hardware and/or position information to the central monitoring station 112 (step 712). If it is determined that information is not to be sent to the central monitoring station 112, the system returns to steps 700 and 704. If it is determined that information is to be sent to the central monitoring station 112, a modem 216 or 268 is used to establish a connection with the central monitoring station 112 and to transfer the information (step 716). According to one embodiment of the present invention, all of the hardware parameter and position information stored in the memory 232 of the remote tag 104 is sent to the central monitoring station 112 when a connection is established with the central monitoring station. Although it is convenient to discuss the operation of the remote tag 104 in terms of a linear progression, it should be appreciated that the various subroutines used to perform the monitoring and decision steps described herein need not be run in sequential fashion, but rather may generally operate in parallel with one another.

At step 720, the information sent from the remote tag 104 is received by the tag communicator 600 associated with the central monitoring station 112. The tag communicator 600 receives the position and/or hardware information received from the remote tag 104 and converts that information to one or more events. The event is then passed to the event server 604. The event server 604 in turn provides the event to software agents running on the processor 300 of the central monitoring station 112 (step 724). The database server agent 608 stores the event containing the position or hardware information in the database 612. The records of the database 612 may be contained in the storage 308 associated with the central monitoring station 112. If any of the remaining agents 616 to 628 generates a second event in response to the event containing position or hardware information, such as an alert event, that event is received by the event server 604 and provided to each of the software agents (step 728). Upon receipt of an alert event or other event that requires notification of an authorized user, the contactor agent 628 notifies the authorized user appropriately. For instance, the contactor 628 may notify the authorized user of the event by facsimile 632, e-mail 636, pager 640 or pop-up notification 644 (step 732).

Figure 8:
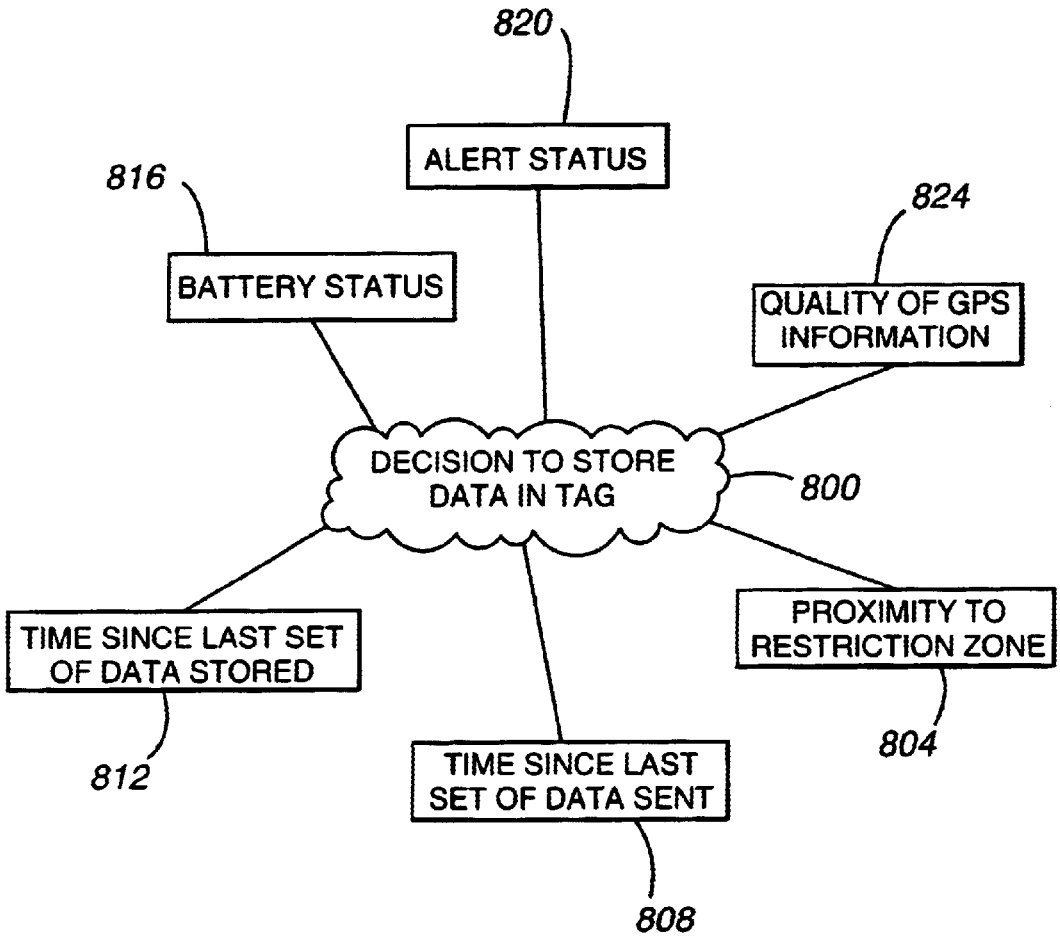
FIG. 8 is a diagram representing factors that may be considered by a remote tag in determining whether to store information in accordance with an embodiment of the present invention.

With reference now to FIG. 8, factors that may be considered by a remote tag 104 in determining whether to store information in the remote tag 104 are illustrated. In general, the decision as to whether to store data 800 in the remote tag 104 takes into account several factors. A first such factor is the proximity of the remote tag 104 to a restriction zone 804. For instance, if the remote tag 104 is determined to be in a geographic area, or restriction zone, that is prohibited, the remote tag 104 is more likely to store information concerning the current position of the remote tag 104 in memory 232. The proximity to a restriction zone 804 may also operate by determining the position of the remote tag 104 with respect to an exclusion zone. For instance, the remote tag 104 is more likely to store current position information if it is determined that the remote tag 104 is within or near an exclusion zone. In addition to determining the absolute position of the remote tag 104, the proximity to restriction zone factor 804 may also consider the velocity and heading of the remote tag 104. For instance, if a remote tag 104 is traveling at such a velocity and heading that its entry into an exclusion zone or exit from a restriction zone is imminent, the remote tag 104 is more likely to store the current position information in memory 232. The restriction zone factor 804 may additionally consider the time of day and day of week in weighing the decision to store data in the tag 800. For example, the restriction zones to which an offender is confined may be broadened to include an employer's premises during the week and during normal working hours, but narrowed after working hours and during the weekend. According to one embodiment of the present invention, only information regarding restriction or exclusion zones in the immediate vicinity of the remote tag 104 is provided to the remote tag from the central monitoring station 112, to reduce the processing and storage requirements of the remote tag 104.

A next factor in the decision to store data in the tag 800 is the time since the last set of data was sent 808. In general, the longer it has been since information was last uploaded from the remote tag 104 to the central monitoring station 112, the more likely it is that the remote tag 104 will decide to save position and other information in the memory 232. If the remote tag 104 has recently sent information to the central monitoring station 112, the remote tag 104 is less likely to store the information immediately available in memory 232.

The time since the last set of data was stored 812 is another factor considered in determining whether to store data 800 in the tag 104. In general, the longer it has been since data was last stored in the memory 232 of the remote tag 104, the more likely it is that data immediately on hand will be stored.

A next factor is the current battery status 816. A low battery status will favor storing data in the remote tag 104.

The alert status 820 is another factor considered in determining whether to store data 800 in the tag 104. For instance, if the remote tag 104 is associated with a dangerous criminal offender, the authorized user may set a high alert status 820, to favor the frequent storage of data. A higher alert status thus allows closer monitoring of the position and hardware condition of a remote tag 104 by creating a more detailed record of such information.

The quality of GPS information 824 is still another factor that may be considered in deciding whether to store data 800. For instance, where the position information is such that the positioning receiver 208 is unable to calculate the position of the remote tag 104 or the calculated position is determined to be erroneous, that position information is less likely to be stored.

In general, the factors 804 to 824 are assigned different weights, and are considered simultaneously in deciding whether to store data 800. As a result of the use of such "fuzzy logic" techniques, only information that is determined to be more relevant is stored in the memory 232 of the remote tag 104. Because a decision as to the relevance of the information is made each time position information is received, less memory 232 than might otherwise be required to maintain a useful record of the position and status of a remote tag 104 is required. Also, the use of a fuzzy logic type algorithm results in the storage of data in the remote tag 104 aperiodically. The factors described above are examples, and need not all be considered in determining whether to store data 800. Also, additional or different factors may be considered in making a decision 800.

Figure 9:
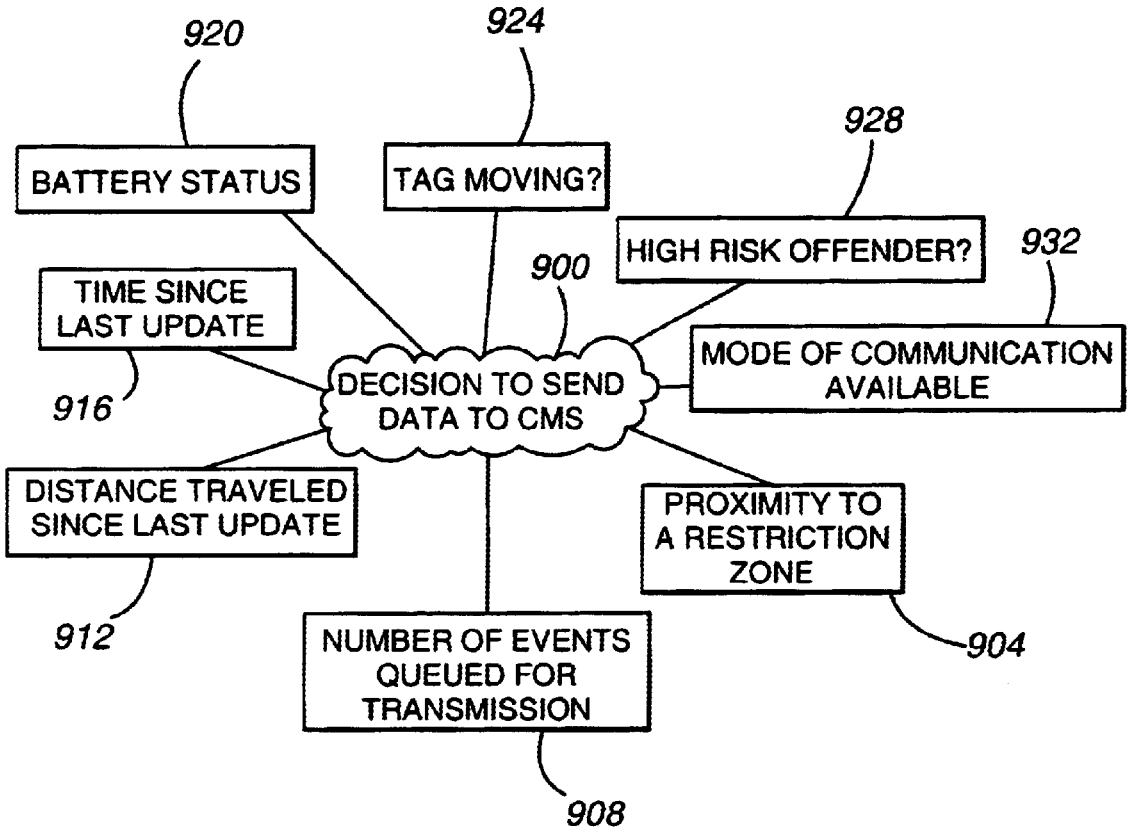
FIG. 9 is a diagram representing factors that may be considered by a remote tag in determining whether to transmit information in accordance with an embodiment of the present invention.

With reference now to FIG. 9, the factors that may be considered by a remote tag 104 in deciding whether to transmit data 900 to a central monitoring station 112 are illustrated. A first such factor is the proximity of the remote tag 104 to a restriction zone 904. As discussed above with respect to the decision to store data 800, the proximity to a restriction zone considers whether the remote tag 104 is in a restriction zone, or whether the remote tag 104 is traveling at a velocity and on a bearing that will bring the remote tag 104 outside of the restriction zone in the near future. Similarly, the proximity to a restriction zone factor 904 may also consider whether the remote tag 104 has moved into an exclusion zone, or whether its trajectory will soon place it within an exclusion zone. A remote tag 104 that is outside of a restriction zone, moving towards a restriction zone boundary, within an exclusion zone, or moving towards an exclusion zone boundary is more likely to transmit data 900 to the central monitoring station 112.

The number of events queued for transmission 908 is another factor considered in deciding whether to send data 900 to the central monitoring station 112. Generally, the greater the number of discrete positions or pieces of hardware information stored in memory 232 the more likely it is that the remote tag 104 will decide 900 to send data to the central monitoring station 112.

The distance traveled since the last transmission 912 is another factor. In general, the greater the distance traveled by the remote tag 104 since information was last transmitted the more likely it is that the remote tag 104 will decide 900 to send data to the central monitoring station 112.

Similarly, the time since the last transmission or update 916 is another factor. The greater the time that has elapsed since the previous transmission of data to the central monitoring station 112 the more likely it is that data will be sent to the central monitoring station 112.

Another factor is the battery status 920 of the remote tag 104. If the power of the battery 236 is low, the transmission of data to the central monitoring station 112 is likely to be deferred, as establishing a communications channel 108 and transmitting is an operation that requires a relatively large amount of battery power.

A further consideration is whether the tag is moving 924. If the remote tag 104 is moving, it is more likely that data will be sent to the central monitoring station 112. This is because position information is more significant when the remote tag 104 is moving.

Another consideration is whether the remote tag 104 is associated with a high risk offender 928. In general, a high risk offender, or a person to whom a higher alert status is assigned, will require more frequent transmissions of data to the central monitoring station 112. Frequent transmissions of data with respect to remote tags 104 associated with persons or assets having a high alert status allows an authorized user to more closely track the position of the monitored person or asset.

Yet another factor is the mode of communication available 932. For instance, if the remote tag 104 is interconnected to a base station 256, the transmission of data to the central monitoring station 112 may be deferred, in order to avoid tying up the telephone line of the person associated with the remote tag 104 by using the modem 268 in the base station 256. Where, for example, a remote tag 104 is provided with a CDPD modem and an analog wireless modem, transmission of data may be more likely if the CDPD modem is in service, rather than if only the analog modem is capable of transmitting a signal. According to this example, transmission using a CDPD modem is favored, because connection costs charged by communications companies are generally lower with respect to CDPD transmissions, and because the cost in battery life of transmitting using an analog wireless modem is relatively high. As a further example, the remote tag 104 of a passive tracking remote subsystem 200 (see FIG. 2C) may always send data over the modem 268 in the base station 256 when the remote tag 104 is initially placed in communication with the base station 256.

The factors 904 to 932 may be assigned varying weights. In particular, the factors considered with respect to a decision to send data 900 may be applied to an Artificial Intelligence Inference Engine. Such an engine may utilize fuzzy logic, expert systems, neural networks, simulated annealing, genetic algorithms, or other artificial intelligence techniques. The use of a fuzzy logic algorithm allows the system 100 to ensure that information transmitted from the remote tag 104 to the central monitoring station 112 is of relatively high significance. This avoids overloading the central monitoring station 112 with repetitive and relatively insignificant data, and helps to reduce the costs of operating the system 100 by reducing air time on the wireless network 416 or other communications networks. The fuzzy logic algorithm also reduces the power requirements placed on the battery 236. In addition, the use of fuzzy logic algorithm that considers a plurality of factors results in a system 100 that transmits information from the remote tag 104 to the central monitoring station 112 aperiodically. The factors described above are examples, and need not all be considered in making a decision to send data 900. Also, additional or different factors may be considered in making the decision 900.

From the above description, it should be appreciated that the remote tag 104 uses adaptive update techniques to determine when to store and when to transmit data. In particular, the remote tag 104 alters the rate at which data is stored in the remote tag 104 or sent to the central monitoring station 112 based on current conditions. The goal is to collect and to transmit a stream of significant information. Therefore, a slower update rate is adopted when the data being collected or that has been collected by the remote tag 104 contains no or little new information, such as when the remote tag is stationary. In such circumstances, the data collected is repetitive, and a stream of such data can be considered to contain little information. A higher update rate is adopted when significant information is collected by the remote tag. For example, a higher data storage and/or data transmission update rate may be adopted to provide a detailed history of the remote tag's 104 movements when position data indicates that the remote tag is moving quickly or is moving towards an exclusion zone boundary. Data may also be stored and/or transmitted when a single instance of significant information is collected, such as when the remote tag enters an exclusion zone, leaves an inclusion zone, or when the status of the remote tag 104 changes. With respect to the transmission of data, the time since the remote tag 104 last contacted the central monitoring station 104 may be considered. If it is determined that the central monitoring station is expecting a transmission of data, such a transmission may be made to indicate to the central monitoring station 112 that the remote tag 104 is functioning properly.

Figure 10:
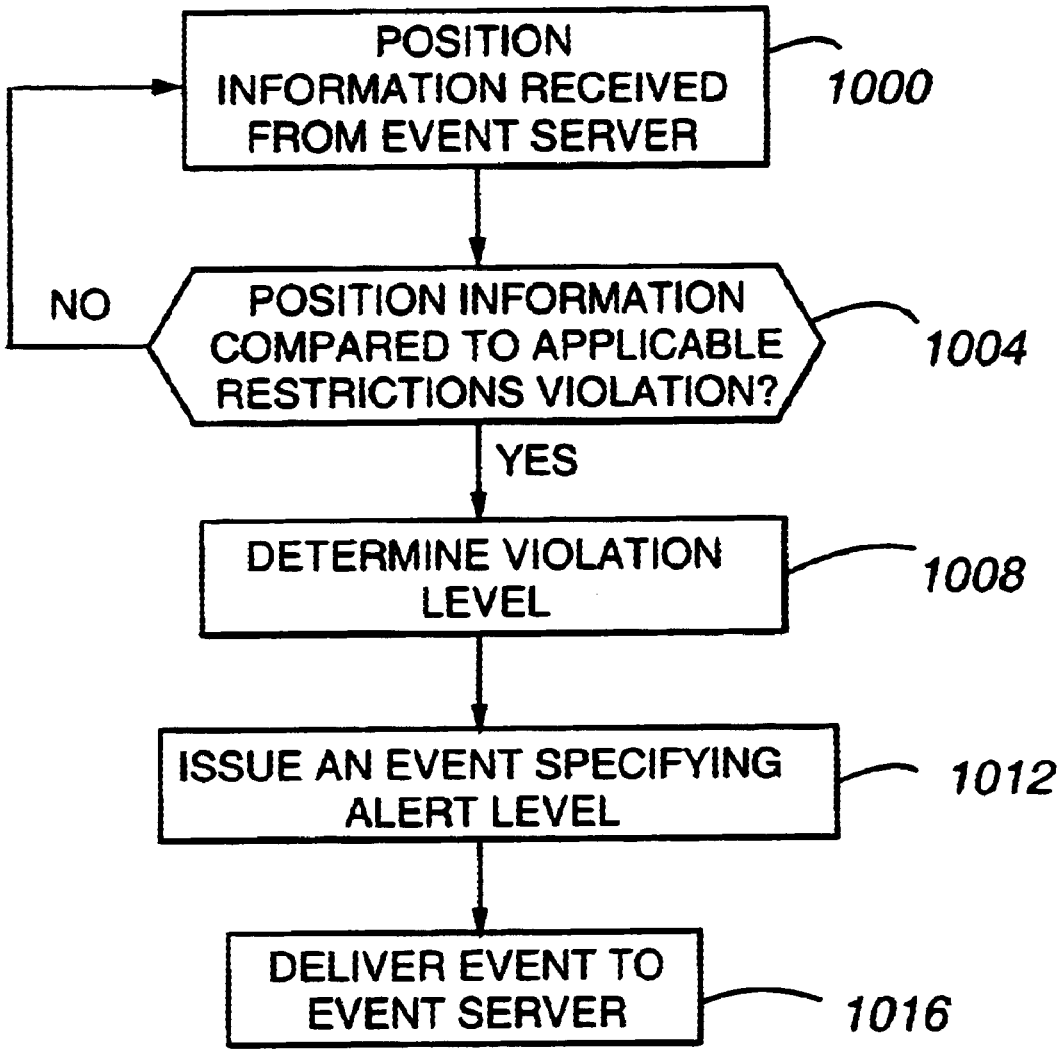
FIG. 10 is a flowchart of the operation of a restriction checker function in accordance with an embodiment of the present invention.

FIG. 10 is a flow chart of the operation of a restriction checker 620 function in accordance with an embodiment of the present invention. Initially, at step 1000, the restriction checker 620 receives an event containing position information from the event server 604. The received position information is compared to applicable restrictions (step 1004). For instance, the restriction checker 620 determines whether the remote tag 104 is within a restriction zone (i.e. an area in which the remote tag 104 is required to remain). Alternatively or in addition, the restriction checker 620 may determine whether the remote tag 104 is within an exclusion zone (i.e. a geographic area that the remote tag 104 is prohibited from entering). The geographic boundaries defining restriction and exclusion zones may be varied or eliminated depending on the time of day or the day of the week. For instance, a parolee may be allowed to leave his or her county of residence in order to travel to a workplace during the week, but restricted from leaving their home county after work hours and on the weekends. If the position information is not in violation of an established restriction or exclusion zone, the system returns to step 1000 to await receipt of a next set of position information.

If the remote tag 104 is in violation of a restriction or exclusion zone, the restriction checker 620 determines the level of the violation (step 1008). For instance, a violation may be assigned a high level of alert if it concerns a criminal offender who has entered an exclusion zone and the exclusion zone has been established to protect the victim of a previous crime committed by the offender. In contrast, a lower alert level may be assigned to a violation associated with a child leaving a school yard, as the alert may be triggered simply to notify a monitoring parent that the child is on his or her way home. After determining the appropriate alert level, an event is issued specifying that alert level 1012. The event, specifying the alert level, the remote tag 104 with which the alert is associated, the position of the remote tag 104 and the reason the alert was generated is issued, and the newly issued event delivered to the event server (step 1016).

The restriction checker 620 is a software agent. Therefore, the restriction checker 620 is adapted to perform a discrete task or limited set of tasks with respect to selected pieces of position information. For instance, the restriction checker normally considers the relative location of parolees. However, where the system 100 is also used in connection with, for example, the tracking of a child or an asset, the restriction checker function does not necessarily need to be performed. In addition, alert events generated by other software agents do not need to be considered by the restriction checker 620. In this way, the events that are substantively analyzed by the restriction checker 620 comprise a subset of the total number of events in the system 100. The workload of the restriction checker 620 is further limited, and the code used to implement the restriction checker 620 is simplified and made more efficient, by considering only the relative positions of persons or assets covered by the restriction checker function. For example, the restriction checker 620 does not determine whether an offender is within close proximity to another offender.

Figure 11:
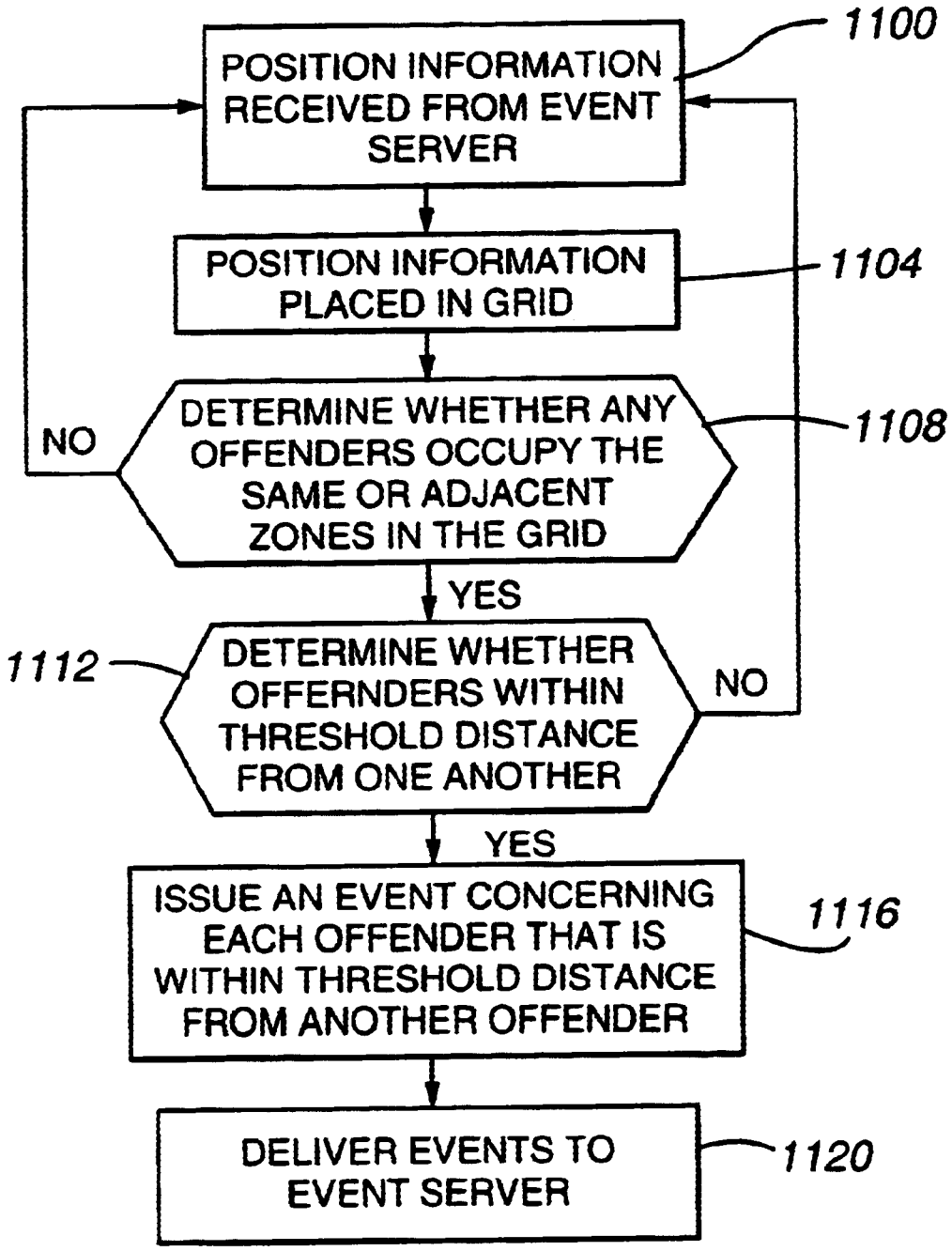
FIG. 11 is a flowchart illustrating the operation of a group detector function in accordance with an embodiment of the present invention.

FIG. 11 is a flow chart illustrating the operation of the group detector 624 agent according to an embodiment of the present invention. Initially, at step 1100, position information is received from the event server 604. The position information is next placed in a grid overlaying the geographic areas considered by the system 100 (step 1104). In general, the use of a grid, or "quad tree structure" allows the group detector 624 to efficiently consider the relative positions of tracked assets or persons. In general, position information regarding discrete assets or persons is placed in the grid. The group detector 624 then determines whether two or more assets or persons subject to gross restriction checking are in close proximity (step 1108). If no two tracked assets or persons are in close proximity, the system returns to step 1100 to await the receipt of additional position information from the event server 604.

If two or more tracked assets or persons do occupy the same or adjacent grid zones, a determination is made as to whether the tracked assets or persons are within a threshold distance from one another (step 1112). If no two tracked assets or persons are within the threshold distance from one another, the system returns to step 1100 to consider a next event received from the event server 604. If the threshold distance is met, and the group is determined to be prohibited, an event is issued with respect to each asset or person within the detected group (step 1116). These events are then delivered to the event server 604 (step 1120). The system may then return to step 1100.

The group detector 624 may, in considering relative position data, take into account exceptions to the group detector function. For instance, groups detected within a zone that includes a parole office or a workplace where two or more parolees are known to work may not trigger the generation of alert events. In addition, such exceptions may have a time component. For instance, the exception may only apply during or around the times that a parole office or place of employment are open for business.

The group detector 624 may utilize a quad tree structure for organizing and considering the two dimensional position data concerning tracked assets or persons. In a quad tree structure, a geographic area is divided into zones by overlaying a grid. The algorithm then determines whether two or more tracked assets or persons occupy the same grid zone. Preferably, the group detector 624 utilizes a modified quad tree structure, in which the restriction checker 620 also determines whether tracked assets or offenders occupy adjacent grid zones. If it is determined that two or more tracked assets or persons occupy the same or adjacent grid zones, the group detector 624 may then calculate the relative distance of the tracked assets or persons from one another. The use of a modified quad tree structure allows the group detector 624 to efficiently determine whether prohibited groups have formed.

Figure 12:
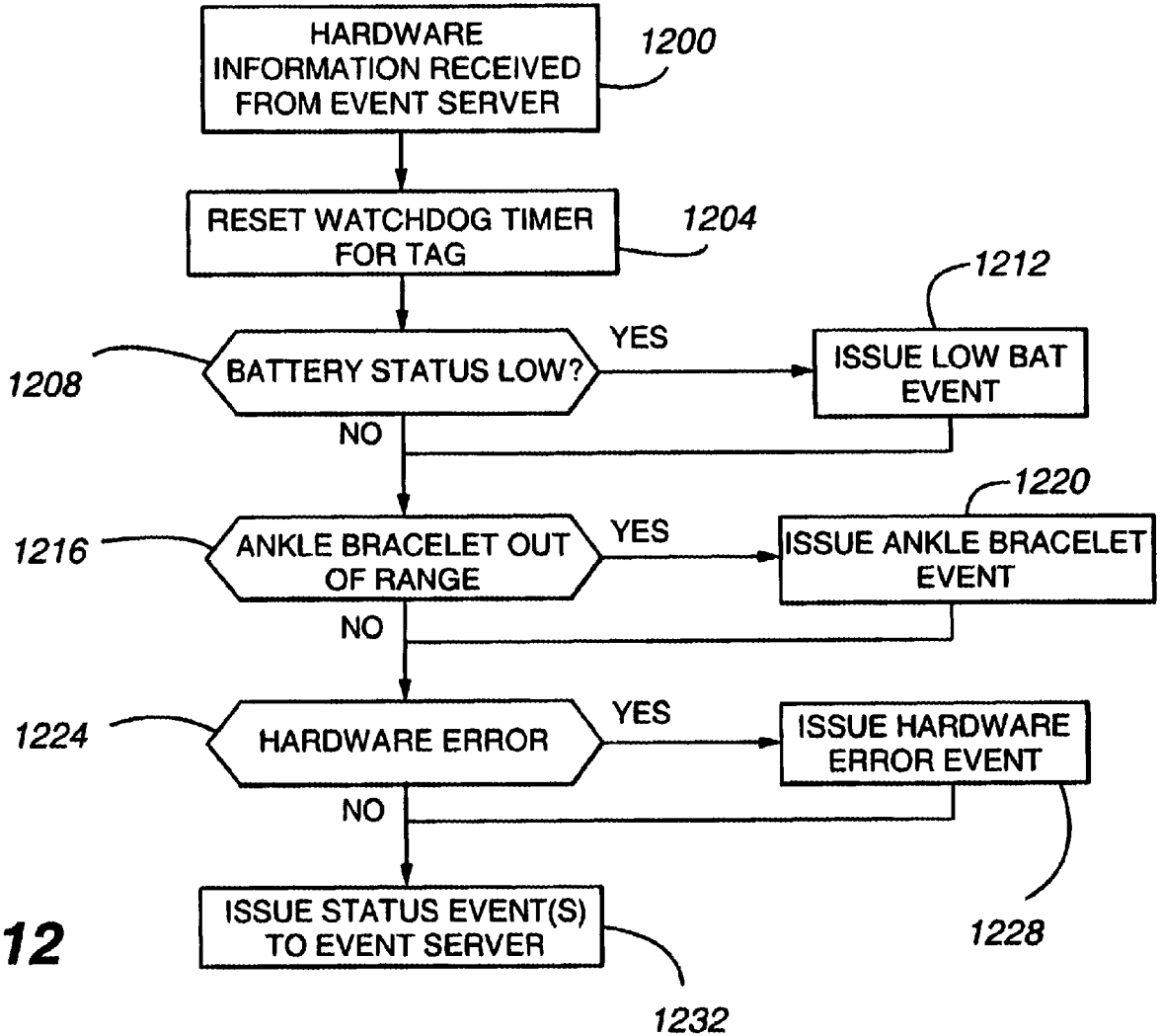
FIG. 12 is a flowchart illustrating the operation of certain aspects of a hardware monitor function in accordance with an embodiment of the present invention.

With reference now to FIG. 12, the operation of certain aspects of a hardware health monitor 616 are illustrated. Initially, at step 1200, information regarding monitored hardware parameters are received from the event server 604. Next, the watchdog timer maintained with respect to the remote tag 104 issuing the information is reset (step 1204). A watchdog timer is maintained for each remote tag 104 in the system 100.

The hardware health monitor agent 616 then checks whether various hardware parameters are operating properly. For instance, at step 1208, the hardware health monitor 616 determines whether the battery 236 is adequately charged. If the battery status is found to be low, a low battery event is issued (step 1212). The hardware health monitor agent 616 may also determine whether the ankle bracelet or other proximity verification device 240 is within range of the proximity detector 224 or the enhanced proximity detector 260 (step 1216). If neither proximity detector 224 or 260 receives a proper identification signal 254 an event is issued to signal that the proximity verification device 240 and presumably the offender to which the proximity verification 240 is attached, has left the vicinity of the remote tag 104 (step 1220). The hardware health monitor agent 616 may also determine whether a hardware error has occurred (step 1224). For instance, the microprocessor 204 of the remote tag 104 may determine that one or more attached devices are not operating properly, and this information may be sent to the central monitoring station 112. A hardware error may also be indicated by activation of one or more tampering sensors 238 and 253. For instance, a tampering sensor 238 in the remote tag 104 may signal tampering if the remote tag 104 casing 222 is opened. Similarly, the tampering sensor 253 may generate a signal indicating tampering with the proximity verification device 240 if, for example, the band attaching the proximity verification device 240 to an offender has been cut. This signal may be provided to the remote tag 104 by the identification transmitter 244, and passed to the central monitoring station 112. If any such hardware error is detected, a hardware error event is generated (step 1228). Following the generation of any of the above described events 1212, 1220 and 1228, those events are issued to the event server 604 (step 1232).

Figure 13:
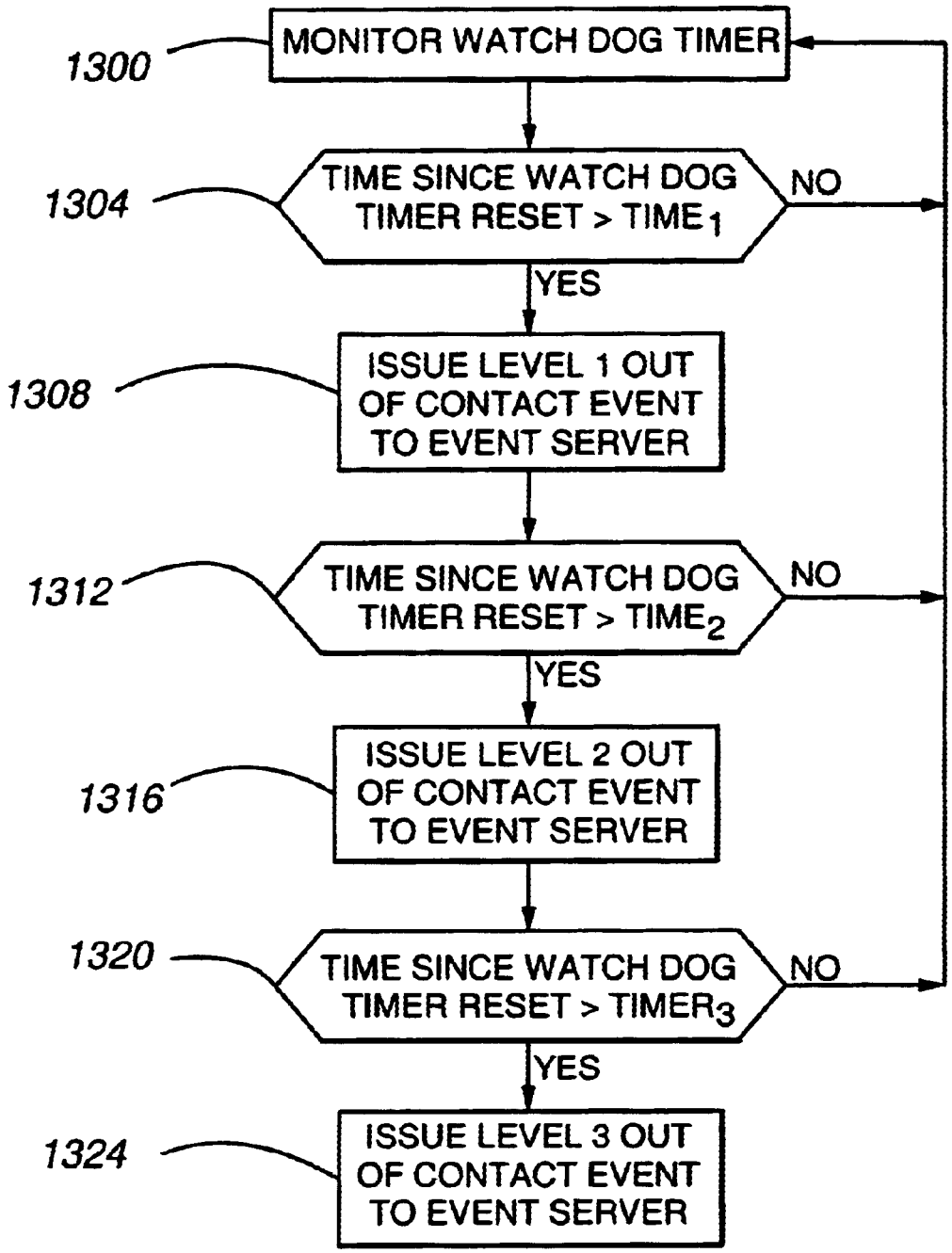
FIG. 13 is a flowchart illustrating certain other aspects of the operation of a hardware monitor function in accordance with an embodiment of the present invention.

With reference now to FIG. 13, certain additional aspects of the operation of the hardware health monitor agent 616 are illustrated. Generally, as mentioned above, the hardware health monitor agent 616 maintains a watchdog timer with respect to each remote tag 104 included in the system 100. At step 1300, the status of the watchdog timers are monitored. With respect to each monitored watchdog timer, the hardware health monitor agent 616 determines the time since each watchdog timer has been reset (step 1304). If the time is greater than a first time period, a level one out of contact event may be issued to the event server (step 1308). According to one embodiment of the present invention, after an alert event is issued, the monitoring of the watchdog timers continues. With respect to the watchdog timer that exceeded the first time value, monitoring continues. If that timer is not reset, and exceeds a second time period (step 1312), the system issues a level two out of contact event to the event server 604 (step 1316). According to one embodiment of the present invention, further levels of alerts may be issued if the watchdog timer is still not reset. For instance, at step 1320, the hardware health monitor agent 616 may determine whether a watchdog timer has exceeded a third time period. If the third time period is exceeded, a level three out of contact event may be issued to the event server 604 (step 1324).

The operation of the hardware health monitor agent 616 with respect to the monitoring of the watchdog timer associated with a remote tag 104 is substantially continuous. Furthermore, it will be appreciated that different time periods and progressions through various alert levels may be modified by the authorized user to suit particular assets or persons being tracked.

Figure 14:
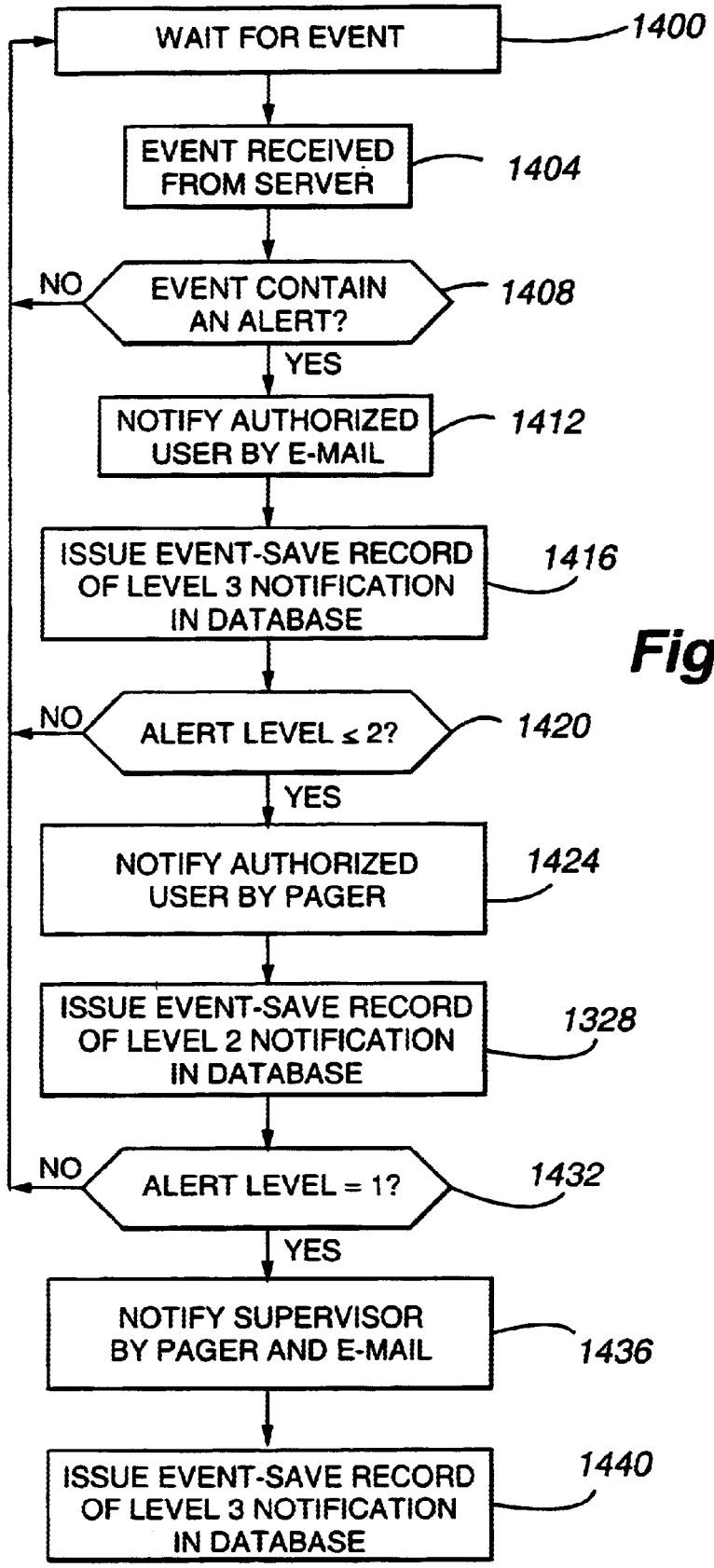
FIG. 14 is a flowchart illustrating the operation of a contactor function in accordance with an embodiment of the present invention.

With reference now to FIG. 14, an example of the operation of a contactor 628 in accordance with an embodiment of the present invention is illustrated. Initially, the contactor 628 waits for an event to arrive (step 1400). An event is then received from the event server 604 (step 1404) and the event is analyzed to determine whether it contains an alert (step 1408). In general, if a received event does not contain an alert, no action is taken by the contactor 628, and the contactor 628 returns to step 1400 to await the arrival of a next event.

If the event is determined to contain an alert, the contactor 628 issues notification of the alert to the person or persons and using the method or methods defined by the authorized user. For instance, the contactor 628 may notify the authorized user by e-mail (step 1412). The contactor 628 may then issue an event containing information regarding the method and recipient of the notification and regarding the event triggering the notification for storage by the server agent 608 in the database 612 (step 1416).

The contactor 628 may next determine whether the alert was of level two or greater (step 1420). If not, the contactor 628 returns to step 1400 to await the receipt of a next event. If it is determined that the alert level is less than or equal to level two, the authorized user may be notified by pager (step 1424). The contactor 628 may also issue an event containing information regarding the notification and the event that triggered the notification for storage in the database 612 (step 1428).

Next, the contactor 628 may determine whether the alert was a level one alert (step 1432). If the alert was not level one, the contactor 628 returns to step 1400 to await the arrival of a next event. If the received event contained a level one alert, the supervisor of the authorized user may also be notified by pager and e-mail (step 1436). The contactor 628 may then issue an event containing information regarding the level one notification and the event that triggered that notification (step 1440) for storage in the database 612.

It will be appreciated that the authorized user may select the methods and recipients of alert notifications. Furthermore, it will be appreciated that any number of alert levels may be provided for. In general, by providing for layered notifications of alerts, events can be treated appropriately. For instance, a restriction zone comprising a school may be assigned a low level alert, and may trigger a pop-up window in a user interface 120 associated with an authorized user who is a parent of a child being tracked by the system 100, if a violation of the zone occurs at the end of a school day. That is, the contactor 628 may be used to inform the parent that his or her child has left school for the day. In contrast, a high level alert resulting in the notification of both parents of a monitored child by pop-up notification in a user interface 120 and by pager may be issued if the child leaves the restriction zone during normal school hours. In summary, the contactor 628 may be used to provide a relatively unobtrusive alert to provide notification of an event that is significant but that does not necessarily require immediate attention, while more emphatic means of communicating significant events may be employed in connection with events that may require immediate attention.

Figure 15:
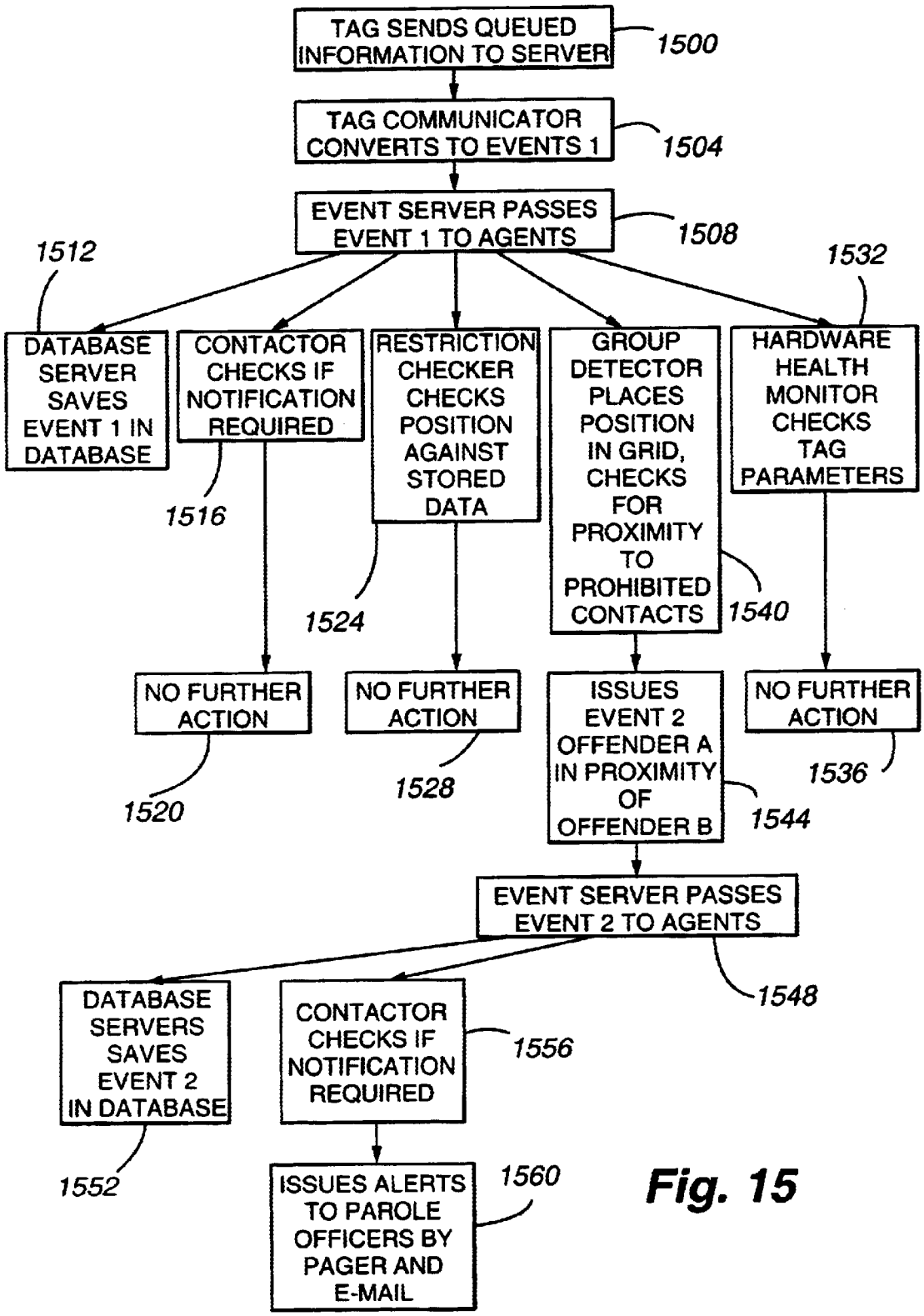
FIG. 15 is a flowchart illustrating the operation of a system in accordance with an embodiment of the present invention in the context of an example.

An example of the operation of a system 100 in accordance with an embodiment of the present invention is illustrated in FIG. 15. Initially, at step 1500, a remote tag 104 sends queued information to the central monitoring server or station 112. As described above, a remote tag 104 will send information to the central monitoring station 112 after a variety of factors have been considered. At step 1504, the information is received by the tag communicator 600, which converts the received information an event or series of events. Typically, information transmitted from the remote tag 104 contains a number of geographic locations at various times and may include information concerning one or more parameters. Accordingly, the information received from the remote tag 104 is typically divided into a number of events, each event containing a discrete location, or containing information regarding one or more hardware parameters. For purposes of the present example, a first event generated as a result of the information received from the remote tag 104 will be considered. The event server 604 receives the first event from the tag communicator 600 and passes the event each of the agents 608 and 616 to 628 (step 1508).

The database server 608 saves the first event in the database 612. The database server 608 generally ensures that a complete record of all events generated within the system 100 is maintained (step 1512). In this way, an authorized user may query the database 612 when desired to review the complete set of position data concerning a tracked person or asset.

The first event is also provided to the contactor 628 (step 1516). In general, the contactor 628 reviews the event to determine whether notification of any designated person is required. In the present example, the first event comprises position received from the remote tag 104 that has no alert associated with it. Accordingly, the contactor 628 takes no further action (step 1520). It should be appreciated that position information received from a remote tag 104 may be associated with an alert according to an embodiment of the present invention. For instance, the remote tag 104 may be provided with information concerning exclusion or restriction zones pertaining to that remote tag 104, and an alert may be associated with a set of position information by the remote tag 104. If such an event is associated with an alert, the contactor 628 may take action to notify an authorized user or other person.

The restriction checker 620 is also provided with the first event. The restriction checker 620 checks the position information against any restriction or exclusion zones established in connection with the particular remote tag 104 (step 1524). According to the present example, the set of position information comprising the first event does not violate any restriction or exclusion zone with respect to the remote tag 104 from which the position information originated. Therefore, no further action is taken by the restriction checker 620 (step 1528).

The hardware health monitor agent 616 receives a copy of the first event and reviews that event for any hardware parameters (step 1532). Here, the first event contains only position information and an associated time, and therefore no further action is taken by the hardware health monitor agent 616 (step 1536).

At step 1540 the group detector 624 receives a copy of the first event. The group detector 624 determines the position of the remote tag 104 with respect to the grid overlaying the geographic area of interest, and determines whether other remote tags 104 are in the same or adjacent grid zones (step 1540). According to the present example, the group detector 624 determines that the remote unit 104 with respect to which the first event has been generated occupies a grid zone adjacent to a grid zone occupied by a second remote unit 104. Furthermore, the group detector 624 determines that the first and second remote tags 104 are associated with parolees. Having determined that the first and second remote tags 104 are in adjacent grid zones, the group detector 624 calculates the distance between the first and second remote tags 104. Finding that the first and second remote tags 104 are within a predetermined distance of one another, the group detector 624 issues a second event (step 1544).

At step 1548 the second event is received by the event server 604 and is passed to each of the other agents 608 and 616 to 628. Although as described herein the event server 604 copies events it receives to each of the associated agents 608 and 616 to 628, the event server 604 may alternatively be provided with intelligence. In particular, the event server 604 may analyze events it receives to determine the particular agents 608 and 616 to 628 that should be provided with a particular event. According to the present example, the second event is relevant only to the database server 608 and the contactor 628. Accordingly, an intelligent event server 604 may direct the second event to the database server 608 and contactor 628 agents only.

The database server 608 receives the second event and stores it in the database 612 (step 1552). In addition, the contactor 628 receives the second event and analyzes that event to determine if notification is required (step 1556). Here, the second event concerns the proximity of two parolees to one another. The contactor 628 determines that notification of parole officers associated with the criminal offenders is appropriate, and issues alerts to those officers (step 1560). According to the present example, the alerts are issued to the parole officers by both pager and e-mail.

It should be appreciated that software agents in addition to the agents 608 and 616 to 628 described herein may be added to the system 100. For instance, the system 100 may be provided with a predictive restriction checker, that predicts whether the velocity and heading of a remote tag 104 are such that the remote tag 104 will soon enter a restriction zone. By providing notification of such predictions, authorized users may react proactively to prevent potentially dangerous situations. In general, the use of software agents allows for additional agents to be added to the system 100 easily, and without disrupting the function of other agents.

Similarly, less than all of the described agents 608 and 618 to 628 may be beneficially utilized by the system 100. For example, where the system 100 is used to track the location of school children, the group detector agent 624 need not be provided.

The foregoing discussion of the invention has been presented for purposes of illustration and description. Further, the description is not intended to limit the invention to the form disclosed herein. Consequently, variations and modifications commensurate with the above teachings, within the skill and knowledge of the relevant art, are within the scope of the present invention. The embodiments described hereinabove are further intended to explain the best mode presently known of practicing the invention and to enable others skilled in the art to utilize the invention in such or in other embodiments and with various modifications required by their particular application or use of the invention. It is intended that the appended claims be construed to include the alternative embodiments to the extent permitted by the prior art.

What is claimed is:

1. A method of tracking a person using adaptive update techniques, comprising:

monitoring in a remote tag at least a first plurality of parameters;

analyzing in said remote tag at least two of said at least a first plurality of parameters to determine whether to transmit data from said remote tag to a central monitoring station; and in response to determining that data is to be transmitted initiating the transmission of information to a central monitoring station, wherein in order for a determination to transmit information to be made, said at least two parameters must have a value favoring a transmission of data, and wherein a determination that data is not to be transmitted is made if only one of said at least a first plurality of parameters has a value favoring a transmission of data.

2. The method claim 1, wherein said monitoring of a first plurality of parameters is substantially continuous.

3. The method of claim 1, further comprising;

monitoring at least a second plurality of parameters;

analyzing said at least a second plurality of parameters to obtain a second result of at least a first or a second type; and in response to obtaining said second result of said first type, storing said at least a first set of information in said remote tag.

4. The method of claim 3, wherein said monitoring of a second plurality of parameters is substantially continuous.

5. The method of claim 3, wherein said second plurality of parameters comprises at least two of:

time since last transmission of a set of said information to said central monitoring station;

time since a set of said information was last stored in said remote tag;

a hardware parameter;

a proximity of said tag to a restriction zone;

positioning information quality; and an alert status.

6. The method of claim 5, wherein said hardware parameter comprises at least one of:

battery status;

failure to detect a companion device; and hardware tampering.

7. The method of claim 3, wherein said second result of said first type comprises a signal to store at least a first set of information in said remote tag; and wherein a second result of said second type comprises the absence of a signal of said first type.

8. The method of claim 1, wherein said first plurality of parameters comprises at least three of:

time elapsed since a last transmission of said at least a first set of information to said central monitoring station;

distance traveled since said last transmission of said at least a first set of information to said central monitoring station;

a hardware parameter;

whether said remote tag is moving;

mode of communication available;

whether said remote tag is moving towards a restriction or exclusion zone boundary; and a number of sets of information queued for transmission.

9. The method of claim 8, wherein said first plurality of parameters further comprises a status level of said person.

10. The method of claim 8, wherein said hardware parameter comprises at least one of:

battery status;

failure to detect a companion device; and hardware tampering.

11. The method of claim 1, wherein said information comprises position information.

12. The method of claim 11, wherein a time is associated with each piece of position information.

13. The method of claim 11, wherein said information further comprises at least a first hardware parameter.

14. The method of claim 13, wherein said at least a first hardware parameter is selected from the group consisting of:

battery status;

failure to detect a companion device; and hardware tampering.

15. The method of claim 1, wherein said first result of said first type comprises a signal to transmit at least a first set of information to a central monitoring station; and wherein a first result of said second type comprises the absence of a signal of said first type.

16. The method of claim 1, wherein said remote tag comprises a global positioning system receiver.

17. A method of distributing information concerning the position of a person, comprising:

providing first information as a first event to an event sewer, wherein said first information comprises position information;

distributing said first event to at least one of a plurality of software agents located in a central monitoring station;

in response to said at least one software agent determining from said position information that at least one of an inclusion zone or an exclusion zone violation has occurred, generating in said at least one of a plurality of software agents a second event;

providing said second event to said event server;

distributing said second event to at least a second of said plurality of software agents, wherein in response to said second event said second of said plurality of software agents determines an authorized user to notify of said second event; and providing notification of said second event to an authorized user.

18. The method of claim 17, wherein said step of providing notification comprises providing notification by at least one of:

providing an output to a user interface;

e-mail;

pager;

telephone; and facsimile.

19. The method of claim 17, further comprising storing said first and second events in a database.

20. The method of claim 17, wherein said first information comprises position information.

21. The method of claim 20, wherein said first information further comprises information concerning a status of a remote tag from to which said positioning information pertains.

22. The method of claim 17, wherein said step of providing is repeated at indeterminate intervals.

23. The method of claim 17, further comprising generating in a software agent in response to a third event at least one of:

an unauthorized contact alert;

a watchdog timer alert;

an equipment tamper alert;

a battery status alert; and a sensor out of range alert.

24. A system for tracking persons, comprising:

a remote tag, comprising:

a microprocessor;

a positioning system receiver; and a first communications interface, wherein first information is transmitted from said remote tag aperiodically in response to a decision to transmit made in consideration of at least two factors;

a central monitoring station, comprising:

a processor;

a second communications interface, wherein said aperiodically transmitted first information is received by said central monitoring station, wherein said first information comprises position information, wherein in response to determining in said central monitoring station that said position indicated by said first information is at least one of within an exclusion zone and outside of an inclusion zone an event is generated by said processor and is transmitted from said central monitoring station; and a storage device for storing said event;

a user device, comprising:

a third communications interface, wherein said event is received by said user device; and a user interface, wherein said event is presented to a user.

25. The system of claim 24, wherein said positioning system receiver comprises a global positioning system receiver.

26. The system of claim 24, wherein said first communication interface comprises a radio link.

27. The system of claim 24, wherein said first communications interface comprises a wireless modem.

28. The system of claim 27, wherein said wireless modem comprises at least one of a cellular digital packet data modem, a digital cellular modem, an analog cellular modem, a Data TAC modem, a Reflex-25 modem, a two way pager modem, a Bluetooth transceiver, an IEEE 802.11A modem, an IEEE 802.11B modem, and an IrDA infrared modem.

29. The system of claim 24, wherein said first communications interface comprises a wireless phone interface.

30. The system of claim 24, wherein said second communications interface comprises a network interface.

31. The system of claim 30, wherein said network interface is interconnected to the Internet.

32. The system of claim 24, wherein said third communications interface comprises a computer network interface.

33. The system of claim 24, further comprising a proximity verification device, comprising:

an identification transmitter; and a battery, wherein an identification code is output from said transmitter.

34. The system of claim 33, wherein said remote tag further comprises a proximity detector, wherein said identification code is received by said proximity detector when said proximity verification device is within a first distance from said remote tag.

35. The system of claim 34, wherein said first distance is about 25 feet.

36. The system of claim 33, further comprising a base station, comprising:

a fourth communication interface for interconnecting said base station to said central monitoring station; and an enhanced proximity detector, wherein said identification code is received by said enhanced proximity detector when said proximity verification device is within a second distance from said remote tag.

37. The system of claim 36, wherein said second distance is about 150 feet.

38. The system of claim 36, wherein said base station further comprises:

a fifth communications interface for selectively interconnecting said base station to said remote tag, wherein said first information is aperiodically transmitted to said central monitoring station.

39. The system of claim 24, wherein said storage device stores said first information and said event.

40. The system of claim 24, wherein said second communications interface comprises an interface for communicating with said remote tag and an interface for communicating with said user interface.

41. The system of claim 24, wherein said remote tag is adapted to being worn on an ankle of a person.

42. A system involved in the tracking of persons, comprising:

at least a first remote tag including a positioning receiver that provides positioning information concerning said remote tag, and a processor that determines when first information is to be transmitted, wherein said first information is transmitted aperiodically according to a first set of criteria;

a central monitoring station in communication with said first remote tag that receives said first information from said at least a first remote tag, said central monitoring station including a processor and a storage device, said central monitoring station comparing position information included in said first information to at least a first set of predetermined boundaries, wherein at least a first alert is generated if said first information indicates that said at least a first remote tag has crossed at least a one of said at least a first set of predetermined boundaries; and at least a first user interface in communication with said central monitoring station, said at least a first user interface enabling at least a first authorized user to receive at least said first information and said first alert from said central monitoring station.

43. A system as claimed in claim 42, wherein said first set of criteria comprises at least one of a:

distance traveled since last set transmission of first information to said central monitoring station;

battery status;

whether said remote tag is moving;

mode of communication available;

whether remote tag is moving towards a restriction zone; and number of events queued for transmission.

44. A system as claimed in claim 42, wherein said central monitoring station compares said first information received from said first remote tag to second information received from a second remote tag, and wherein at least a second alert is generated if said first remote tag is within a predetermined distance from said second remote tag, and wherein said at least a first user interface enables said at least a first authorized user to receive said second alert.

45. A system as claimed in claim 42, wherein said central monitoring station compares said first information received from said first remote tag to second information received from a second remote tag, wherein at least second and third alerts are generated if said first remote tag is within a predetermined distance from said second remote tag, and wherein said first user interface enables the first authorized user to receive said second alert, and wherein at least a second user interface enables at least a second authorized user to receive said third alert.

46. A system as claimed in claim 42, wherein at least a third alert is generated by said central monitoring station after at least a first predetermined amount of time has elapsed since said first information was last received from said at least a first remote tag.

47. A system as claimed in claim 42, wherein at least a second alert is generated in response to said at least a first remote tag being removed from a person being tracked.

48. A method for distributing position information, comprising:

receiving said information at a central monitoring station from a remote tag, wherein said information includes position information, wherein a decision to send said information is made by said remote tag based on at least first and second factors, and said information is not sent if only one of said factors favors sending said information;

processing said information in said central monitoring station; and selectively routing at least a portion of said information associated with a first tracked object to an output device located remotely from said central monitoring station and associated with a first authorized user.

49. The method of claim 48, wherein said step of processing comprises determining whether a position associated with said first tracked object included in said position information is within an authorized area.

50. The method of claim 48, wherein said step of processing comprises determining whether a first position associated with said first tracked object included in said information is within a predetermined distance of a second position associated with a second tracked object included in said position information.

51. The method of claim 50, further comprising generating first and second alerts in response to a determination that said first position associated with said first tracked object is within a predetermined distance of said second position associated with said second tracked object, wherein said first alert is provided to said first authorized user, and wherein said second alert is provided to a second authorized user associated with said second tracked object.

52. The method of claim 48, wherein said information comprises hardware health information concerning a first remote unit, and wherein step of processing comprises determining whether said hardware health information indicates a problem associate with said first remote unit.

53. The method of claim 48, further comprising routing a second selected portion of said information associated with a second tracked object to an output device located remotely from said central monitoring station and associated with a second authorized user.

54. The method of claim 48, wherein said selected information is only seen by said authorized user.

55. The method of claim 48, wherein said step of processing is completed with respect to said information without human intervention.

56. The method of claim 48, wherein said central monitoring station comprises at least a first computer.

57. A method for tracking a person, comprising:

receiving at least a first communication from an electronic monitor associated with a monitored person at a central control system located remotely from the monitored person, wherein said first communication is sent in response to at least two factors favoring said communication, and wherein a communication is not sent if only one of said factors favors said communication;

processing said communication by said central control system without and independently of human operator input and control; and sending processed information related to said first communication and based on said processing step without and independently of human operator input and control to a predetermined destination remote from said central control system.

58. A method, as claimed in claim 57, wherein:

said processing step includes analyzing information associated with said first communication.

59. A method, as claimed in claim 57, wherein:

said processing step includes checking information different from information of said first communication.

60. A method, as claimed in claim 57, wherein:

said processing step includes checking stored information available at said central control system related to determining whether to conduct said sending step.

61. A method, as claimed in claim 57, wherein:

said first communication includes information related to a geographic location of the monitored person.

62. A method, as claimed in claim 57, wherein said receiving step is conducted without and independently of human operator input and control.

* * * * *